US006119989A

United States Patent [19]

Hollington et al.

[11] Patent Number: 6,119,989

[45] Date of Patent: Sep. 19, 2000

[54] SUPPORT ASSEMBLY WITH A STORABLE FOOT SUPPORT

[75] Inventors: Geoff A. Hollington, London, United Kingdom; Dean D. Achterhof, Holland, Mich.; Cecil P. Craycraft, Laingsburg, Mich.; Michael L. De Pree, Holland, Mich.; George A. Miles, West Olive, Mich.

[73] Assignee: Herman Miller, Inc., Zeeland, Mich.

[21] Appl. No.: 08/999,453

[22] Filed: Dec. 29, 1997

[51] Int. Cl.[7] ..... F16M 11/24; F16M 11/38; A47B 91/00

[52] U.S. Cl. ..... 248/188.2; 248/188.91; 248/170

[58] Field of Search ..... 248/188.6, 165, 248/166, 170, 188, 188.1, 188.2, 188.4, 188.8, 188.91; 108/115, 160, 8, 9, 6, 124

[56] References Cited

U.S. PATENT DOCUMENTS

| | | | |
|---|---|---|---|
| 1,827,240 | 10/1931 | Kemme . | |
| 1,863,756 | 6/1932 | Lufkin . | |
| 2,283,324 | 5/1942 | Faber . | |
| 2,309,484 | 1/1943 | Meter . | |
| 2,409,622 | 10/1946 | Gottfried | 248/188.9 |
| 2,634,075 | 4/1953 | Mayzel | 248/170 |
| 2,803,510 | 8/1957 | Carbary . | |
| 2,828,578 | 4/1958 | McCabe . | |
| 2,879,118 | 3/1959 | Kolb | 108/115 |
| 2,885,181 | 5/1959 | McCully et al. . | |
| 2,910,803 | 11/1959 | Close . | |
| 2,931,128 | 4/1960 | Hiers et al. . | |
| 3,041,032 | 6/1962 | Wilcox | 248/170 |
| 3,184,195 | 5/1965 | Wahl et al. . | |
| 3,186,025 | 6/1965 | Kesterton . | |
| 3,240,170 | 3/1966 | Shave | 108/32 |
| 3,273,842 | 9/1966 | McMahan, Jr. . | |
| 3,347,509 | 10/1967 | Holz et al. . | |
| 3,602,464 | 8/1971 | Orii . | |
| 3,635,174 | 1/1972 | Ball et al. . | |
| 3,718,306 | 2/1973 | Murray . | |
| 3,866,549 | 2/1975 | Berton . | |
| 3,931,771 | 1/1976 | Kramer . | |
| 3,954,068 | 5/1976 | Roberts et al. | 108/124 |
| 4,056,903 | 11/1977 | Guarnere . | |
| 4,117,784 | 10/1978 | Piretti . | |
| 4,135,690 | 1/1979 | Clarke et al. . | |
| 4,197,685 | 4/1980 | Goulish et al. . | |
| 4,312,086 | 1/1982 | Bianco . | |
| 4,375,300 | 3/1983 | Long et al. . | |
| 4,382,642 | 5/1983 | Burdick . | |
| 4,394,563 | 7/1983 | Schnell . | |
| 4,541,596 | 9/1985 | Price . | |
| 4,562,986 | 1/1986 | Frascaroli et al. . | |
| 4,627,364 | 12/1986 | Klein et al. . | |
| 4,671,479 | 6/1987 | Johnson et al. . | |
| 4,688,748 | 8/1987 | Pruyser . | |

(List continued on next page.)

*Primary Examiner*—Ramon O. Ramirez
*Assistant Examiner*—David Heisey
*Attorney, Agent, or Firm*—Brinks Hofer Gilson & Lione

[57] ABSTRACT

A support assembly for supporting an object on a floor. The support assembly includes a leg member and a heel member mounted on said leg member. The heel member is adapted to engage the floor. A foot member is pivotally attached to the leg member. The foot member is adapted to pivot between an upright storage position and a lateral support position. When in the lateral support position, the foot member is adapted to engage the floor at a point spaced apart from the heel member. In a preferred embodiment, a cover is provided to conceal the foot member when placed in the upright storage position. In a preferred embodiment, the heel member comprises a height adjustable glide device that includes a base portion and a stem portion extending upwardly from the base portion. A shaft is disposed in the stem portion and operable engages an actuator disposed in a cavity formed in the base portion. The shaft operably engages the leg member to provide vertical adjustment of the leg member. In a preferred embodiment, the support assembly also includes a support bracket releasably mounted to the leg member. The support bracket and leg member are adapted so as to permit the support bracket to be rotated between at least three positions relative to the leg member.

25 Claims, 16 Drawing Sheets

U.S. PATENT DOCUMENTS 4,695,022 9/1987 Mendonsa et al. ..... 248/176.1
4,744,536 5/1988 Bancalari .
4,785,742 11/1988 Esslinger .
4,807,838 2/1989 Anderson .
4,875,418 10/1989 Moeckl et al. .
4,884,513 12/1989 Newhouse et al. .
4,918,783 4/1990 Chu .
4,938,153 7/1990 Maes ..... 108/128
4,989,812 2/1991 Lloyd .
5,050,829 9/1991 Sykes .
5,174,532 12/1992 Huang .
5,186,425 2/1993 Keusch et al. .
5,205,421 4/1993 Bustos .
5,237,935 8/1993 Newhouse et al. .
5,285,733 2/1994 Waibel .
5,292,095 3/1994 Cattaneo .
5,332,182 7/1994 Weisz et al. .
5,340,068 8/1994 Sarkisian et al. ..... 248/188.6
5,357,874 10/1994 Palmer .
5,394,809 3/1995 Feldpausch et al. .
5,435,254 7/1995 Amey et al. .
5,546,873 8/1996 Conner et al. .
5,622,344 4/1997 Gracie ..... 248/171

227
225
226
240
224
222
218
217
212
213
216
214
204
35
800
215
202
802
223
200
282
284
208
206
280
210
221
223
804
34
221
274
9
223
400
221
272
7
37
35
289
214
244
37
212
76
206
78
219
218
202
270
204
38
220
70
66
24
422
50
56
52
57
54
58
59

SUPPORT ASSEMBLY WITH A STORABLE FOOT SUPPORT

BACKGROUND OF THE INVENTION

The present invention relates generally to a support assembly for office furniture, such as desks, tables and the like, and in particular, to a support assembly having a storable foot support.

Typically, office furniture work surfaces, such as desks and tables, are supported by one or more support legs. Often, the desk or table is C-shaped. In such a configuration, the top of the support leg is secured along a rear portion of the work surface, so that the work surface extends forwardly from the support leg. A support foot extends forwardly from the bottom of the support leg to engage the floor. In such an arrangement, where the work surface is cantilevered outwardly from one or more support legs, a user can move freely between adjacent desks without the support legs interfering with their knees.

Traditionally, the support foot is fixedly or integrally attached to the support leg so that the moment generated by the cantilevered surface can be effectively transferred from the support leg to the support foot. Often, however, a support foot is not required for stability, such as when the work surface is attached to an adjacent work surface, or when two desks placed side-by-side share a single intermediate leg. In such an arrangement, the intermediate leg is not required to carry any substantial bending moment, and typically does not need a support foot for stability. Similarly, a support leg positioned under the back corner of a corner desk having two additional legs positioned along opposing sides also typically does not carry a significant moment and does not need to be stabilized. In these situations, a support foot can actually interfere with the user's feet or the casters on an office chair, and may not be desirable. In addition, an unnecessary support foot can detract from the aesthetics of the desk by cluttering the space beneath the desk.

It also is desirable to provide support legs that are modular, i.e., that can be installed interchangeably on various desk configurations. A modular support leg is designed to be installed at any location, regardless of the load being carried or the impact on the user's mobility and comfort. The typical support leg, installed in a C-shaped desk, cannot be reconfigured so as not to interfere with the user's feet when placed in a corner or intermediate position, i e., where the support foot is not needed for stability.

In addition, support legs also typically are not capable of being positioned interchangeably at opposite sides of the worksurface, or at the back corner of a corner desk, because the support bracket attached to the top of the support leg typically is fixedly attached to the support leg. Therefore, the support leg cannot be rotated about the longitudinal, vertical axis of the leg so as to allow the leg to be repositioned in other support positions beneath the work surface, or other object being supported. As a result, several types of legs and/or brackets may have to be manufactured and retained in inventory in order to fully configure the work surface assembly.

Support feet typically are fixedly attached to the support leg, and therefore do not provide any front to back leveling capability. Therefore, if a desk is positioned on an uneven floor, the support foot cannot be adjusted to level the work surface. Instead, a leveling screw is usually provided in one or more ends of the foot support. Such a device can increase the height of the support foot, however, and therefore can increase the likelihood of interference with the user's feet or chair.

In addition to leveling screws in the foot support, support legs also can have a leveling device, commonly called a glide device, positioned generally along the longitudinal, vertical axis of the support leg. In this way, each support leg can be raised or lowered a small amount to level the desk from side to side, or from front to back. Glide devices, however, typically include an actuation member which can be difficult to manipulate and adjust. Moreover, the actuation member is often exposed so that an installer can readily access it, or is contained in the support leg so that the leveling screw is exposed below the leg. This can detract from the aesthetics of the glide device and the support leg.

SUMMARY OF THE INVENTION

Briefly stated, a first aspect of the invention is directed to a support assembly for supporting an object, such as a desk, on a floor. The support assembly includes a leg member and a foot member pivotally attached to the leg member. The foot member is adapted to be pivoted about a horizontal axis from an upright storage position, where the foot member can be hidden from view, to a lateral support position, where the foot member is deployed to engage the floor. The support assembly also includes a heel member mounted on the bottom of the leg member. The heel member is adapted to engage the floor at a point spaced apart from the point where the foot member engages the floor.

In a preferred embodiment of the invention, the foot member includes a support arm and a lock arm extending laterally from the support arm. The support arm is pivotally attached to the bottom of the leg member. The lock arm is releasably connected to the leg member with a lock member, preferably configured as a adjustable brace member. Preferably, the brace member threadably engages the lock arm and operably engages the leg member when the foot member is placed in the support position.

In one aspect of the invention, the leg member is attached to and extends downwardly from a rear portion of a work surface member. The foot member is pivotally attached to the leg member and braces the leg member to prevent the work surface assembly from tipping over.

In another aspect of the invention, the leg member is adapted to conceal the foot member when the foot member is placed in the upright storage position. Preferably, the leg member includes a cover which forms a cavity that is adapted to receive the foot member.

In another aspect of the invention, the heel member comprises a height adjustable glide device. The glide device includes a housing adapted to engage the floor, an actuator and a shaft. The housing has a cavity and an opening defining a mouth of the cavity. The actuator is disposed in the cavity and is rotatably mounted to the housing. A portion of the actuator is exposed in the mouth of the cavity for access by a user. The shaft is adapted to threadably engage the leg member and has a bottom end secured to the actuator. Rotation of the actuator by the user causes the shaft to rotate and thereby move the leg member in a generally vertical direction as it threadably engages the leg member.

In yet another aspect of the invention, a support bracket is mounted beneath the worksurface member. The leg member is releasably attached to the support bracket. In a preferred embodiment, the support bracket includes a downwardly extending post member that is received within an upwardly opening socket positioned in the top of the leg member. The post member and socket are shaped so as to allow the support bracket and leg member to be oriented in a plurality of positions relative to the other, whereby the same leg member can be positioned at either end of a worksurface member (with a 90 degree rotation of the support bracket between a right and left side respectively), and also at a corner of a workstation (with a 45 degree inward rotation of one support bracket from either side).

The present invention provides significant advantages over other support assemblies having support feet extending outwardly from a support leg. In particular, when not needed for stability, the foot member can be pivoted to an upright storage position where it is prevented from interfering with a user's feet and chair. The cover and cavity provide a simple way to conceal the support foot when in the upright storage position.

When needed for stability, the foot member can be easily deployed by pivoting it to a lateral support position. Thus, the storable foot member eliminates the clutter beneath a work station when not needed, but is available on demand, for example, when the work station is reconfigured so that the leg member carries a bending moment. In this way, the same support assembly can be used interchangeably in all of the various support positions in a desk system, which thereby eliminates the need to maintain various configurations in inventory. Moreover, the adjustable brace member provides a simple mechanism for bracing the foot member when in its lateral support position, and for disengaging it from the leg member when not needed.

Similarly, the support bracket/leg member interface, i e., the socket and post connection, allows for the same support assembly to be used at any of the support positions beneath the work surface.

The glide device also presents significant advantages in that the majority of the actuator is concealed by the housing, thereby providing an aesthetically pleasing appearance. Moreover, the actuator is readily accessible to the user so that the leg member can be easily adjusted, even when heavily loaded. In this way, the glide device provides an improved mechanism for adjusting the height of the leg member.

The present invention, together with further objects and advantages, will be best understood by reference to the following detailed description taken in conjunction with the accompanying drawings.

DETAILED DESCRIPTION OF THE PREFERRED EMBODIMENTS

Figure 1:
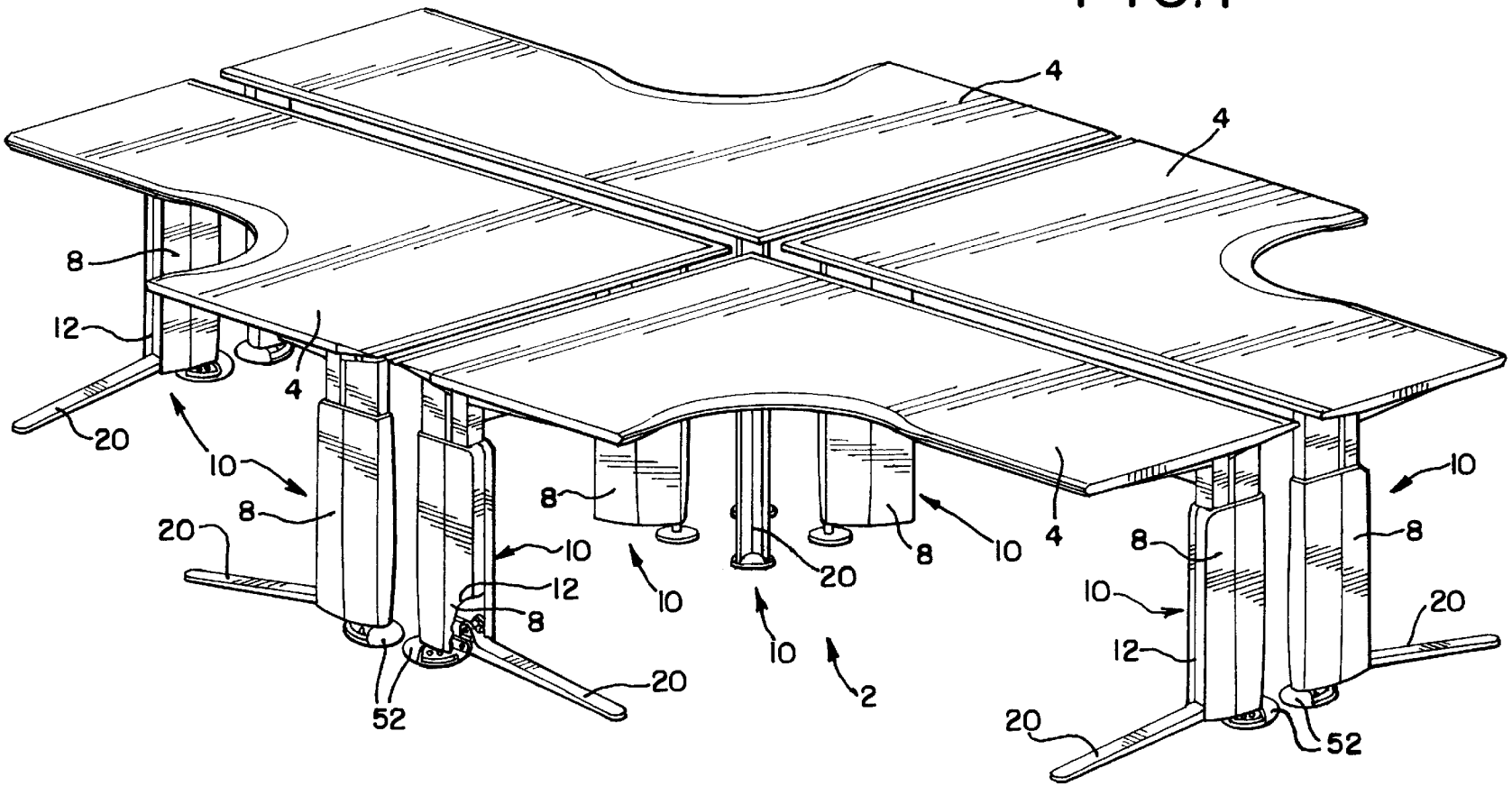
FIG. 1 is a perspective of a desk cluster with a number of desk assemblies having a plurality of support assemblies with storable feet supports placed in both the upright storage position and the lateral support position.

Referring to the drawings, FIG. 1 shows a cluster or assembly of desks 2, each having a work surface member 4 supported by a plurality of support assemblies 10. The support assemblies 10 positioned at the outside ends of the work surfaces 4 include a foot member 20 deployed in a lateral support position. The support assemblies 10 located at the inner corners of the work surface 4 have the foot member 20 placed in an upright storage position. Although the object being supported is depicted as a work surface in the accompanying figures, it should be understood that the support assembly can be used to support a variety of objects, including other office furniture items such as wall panels, cabinets and the like. Accordingly, the disclosure of the desk should be regarded as illustrative rather than limiting.

Figure 3:
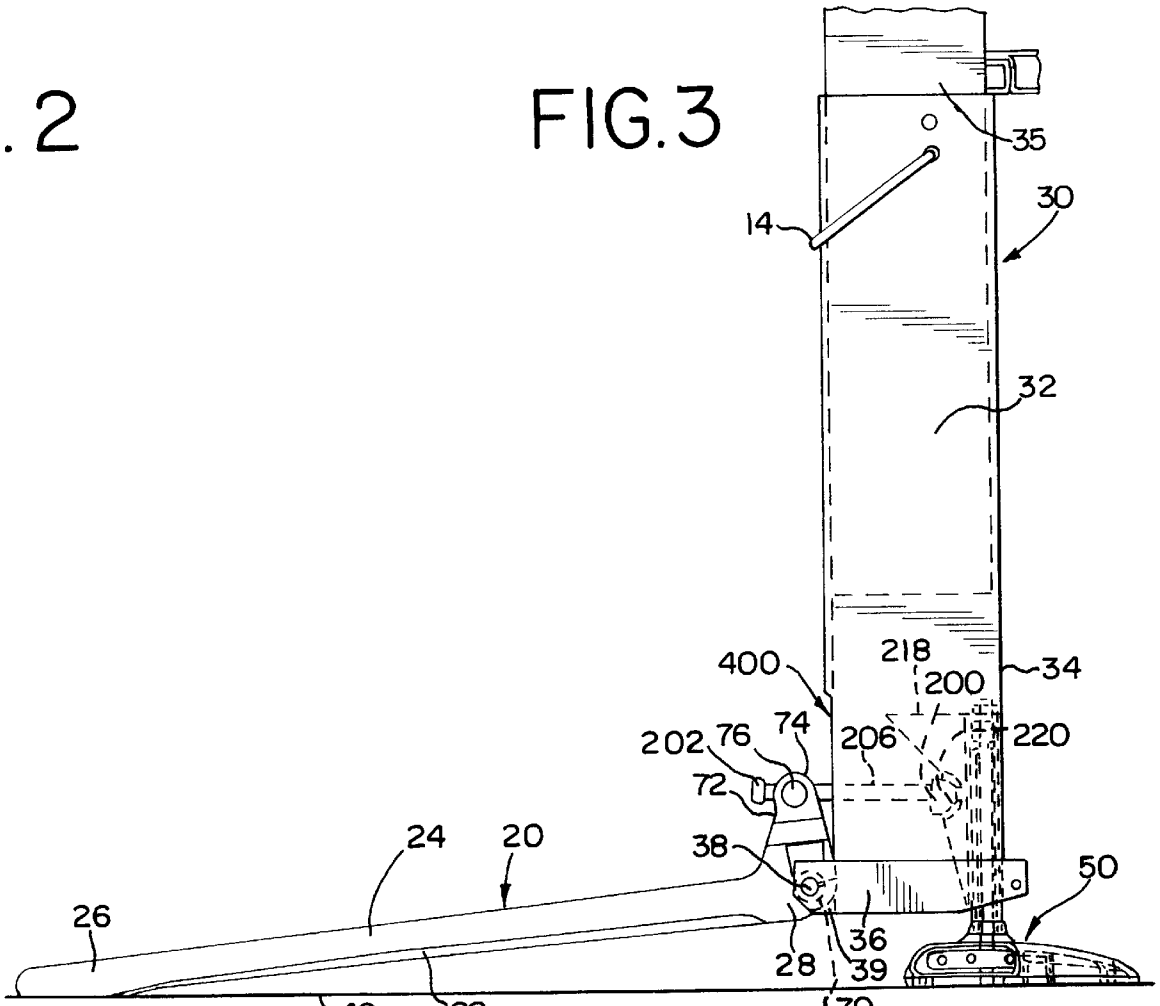
FIG. 3 is a side view of a support assembly, with the cover omitted, having a storable foot support in a lateral support position.
Figure 2:
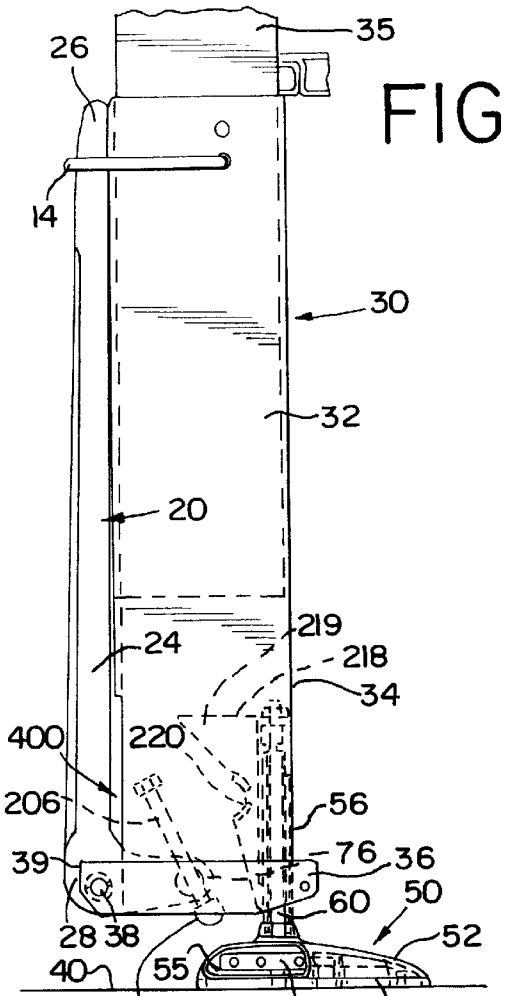
FIG. 2 is a side view of a support assembly, with the cover omitted, having a storable foot support in an upright storage position.
Figure 4:
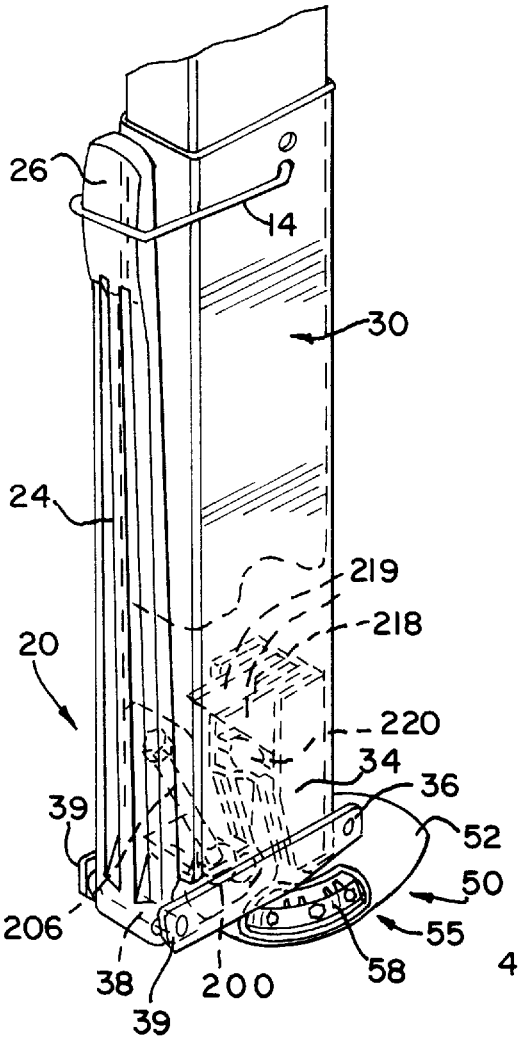
FIG. 4 is a perspective view of a support assembly, with the cover omitted, having a storable foot support in an upright storage position.

Referring to FIGS. 2–4, the support assembly 10 includes a leg member 30 and the foot member 20. The leg member 30 includes a lower leg member 34 and an upper leg member 35 received within the lower leg member 34. Preferably, the upper and lower leg members 34, 35 are formed from steel tubing, although it should be understood by those of skill in the art that other materials, such as aluminum, also could be used. A heel member 50 is attached to and extends downwardly from the lower leg member 34. The heel member 50 is adapted to engage the floor 40. In an alternative embodiment, shown in FIG. 10, a cap 230 member is received in the top of the lower leg member 34.

The lower leg member 34 includes a pair of spaced apart side walls and a pair of support plates 36 disposed along each side of a bottom portion of the lower leg member 34. Preferably the support plates 36 are stamped steel. Each of the support plates 36 extend forwardly from the leg member to form a lug portion 39. As shown in an alternative embodiment in FIGS. 8 and 9, a pair of support plates 37 are mounted to the lower leg member 34 and include a pair of forwardly extending opposing lug portions 35 which are offset inwardly from and lie parallel to the support plate 37.

A support pin 38, preferably steel, is mounted between the lug portions 39, 35 of the support plates 36, 37 at a forward portion of the leg member 30. Alternatively, the support pin can be mounted directly to the lower leg member, which is preferably configured as a steel tube. In such a configuration, the support pin extends between the side walls of the tube, which function as the support plates.

Figure 9:
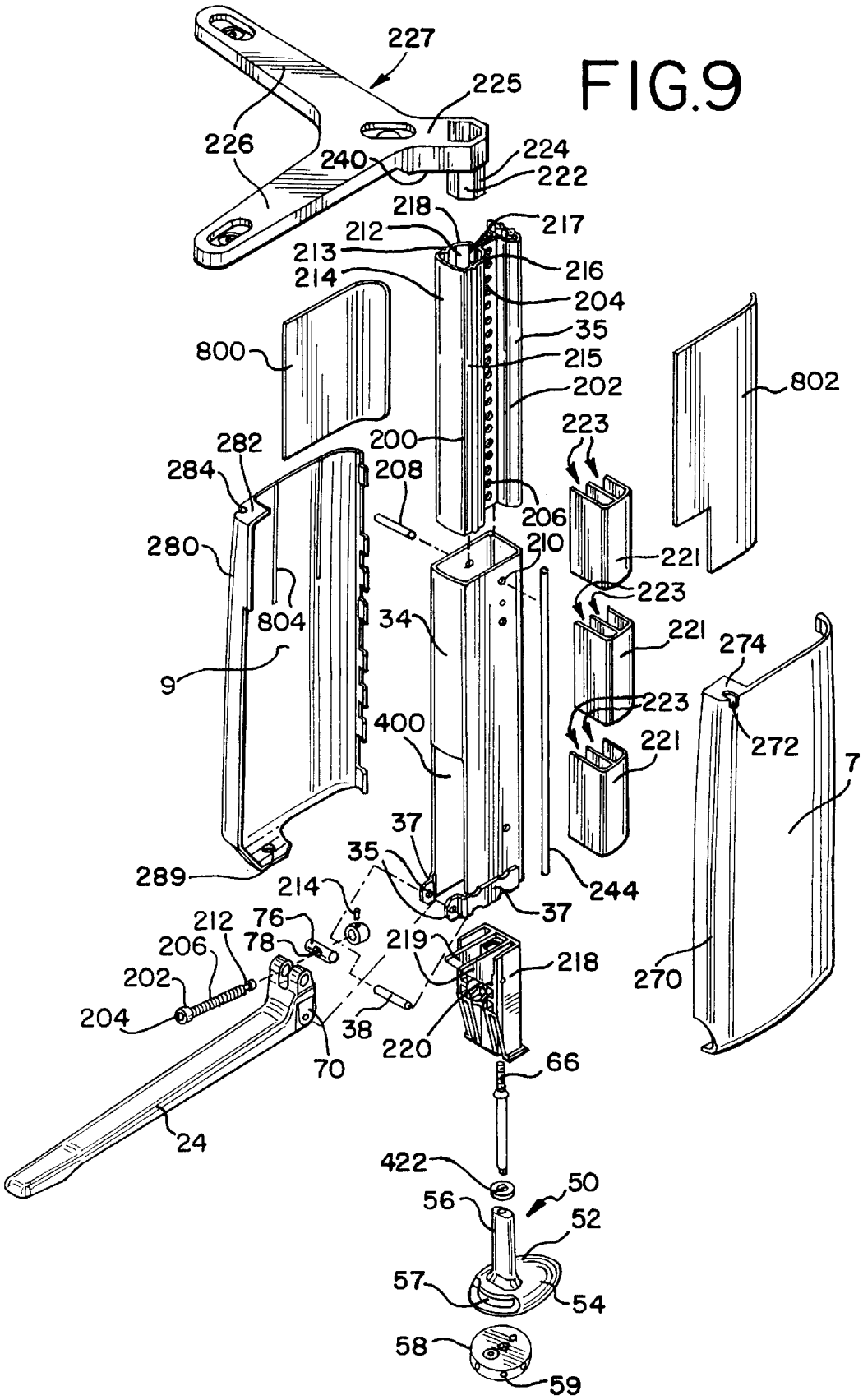
FIG. 9 is an exploded view of a support assembly with a storable foot support and a glide device.

As shown in FIG. 9, one embodiment of the upper leg member 35 includes a first and second tube 200, 202 connected by a web 204. The web 204 has a plurality of holes 206 arranged along its length between the tubes. A lock pin 208 is inserted through a pair of holes 210 positioned in a top portion of the lower leg member 34 and one of the holes in the 206 in the web 204 so as to releasably secure the lower leg member 34 to the upper leg member 35. In this way, the leg member 30 is made height adjustable.

Figure 10:
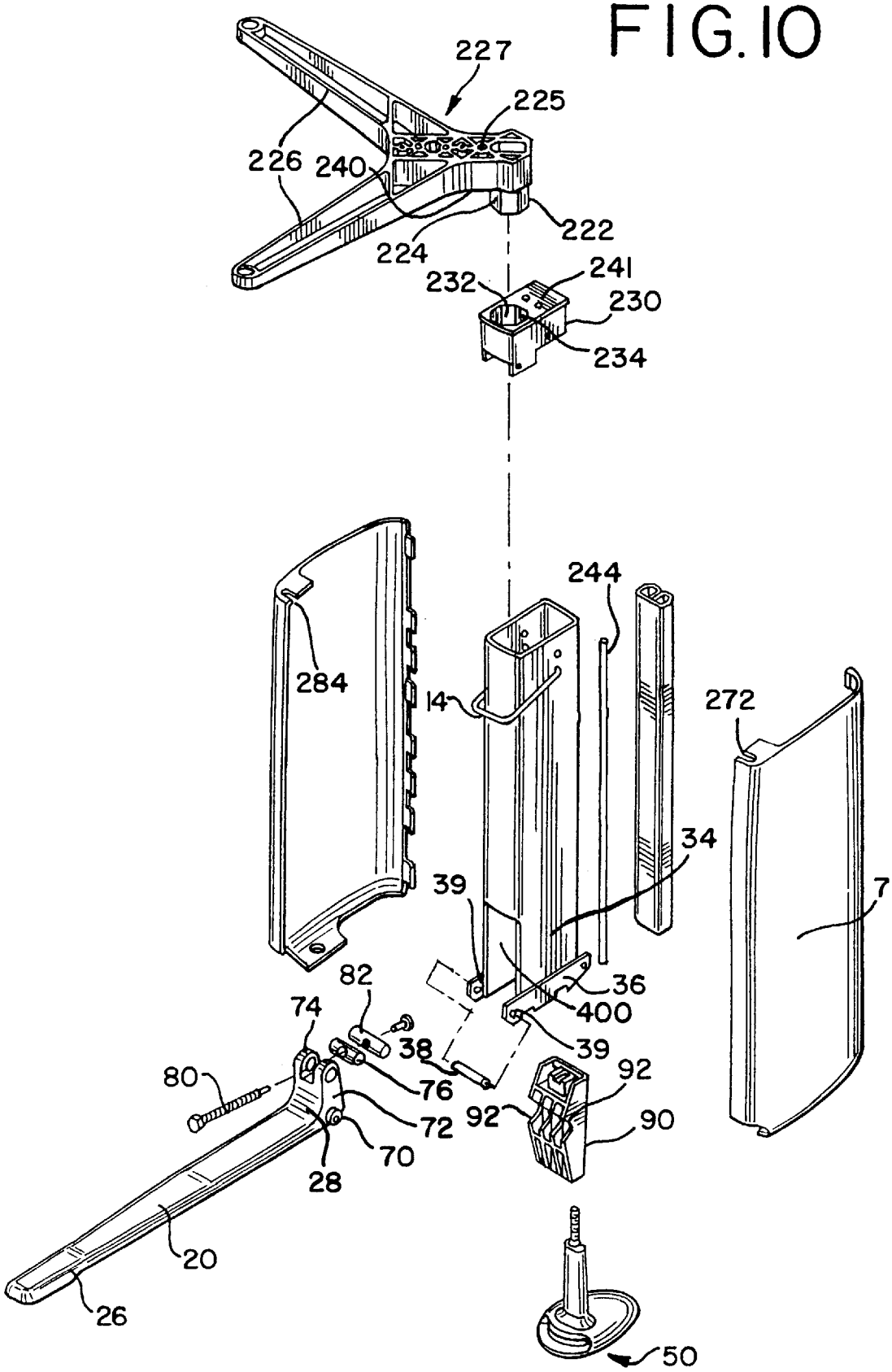
FIG. 10 is an exploded view of an alternative embodiment of the support assembly with a storable foot support and a glide device.
Figure 12:
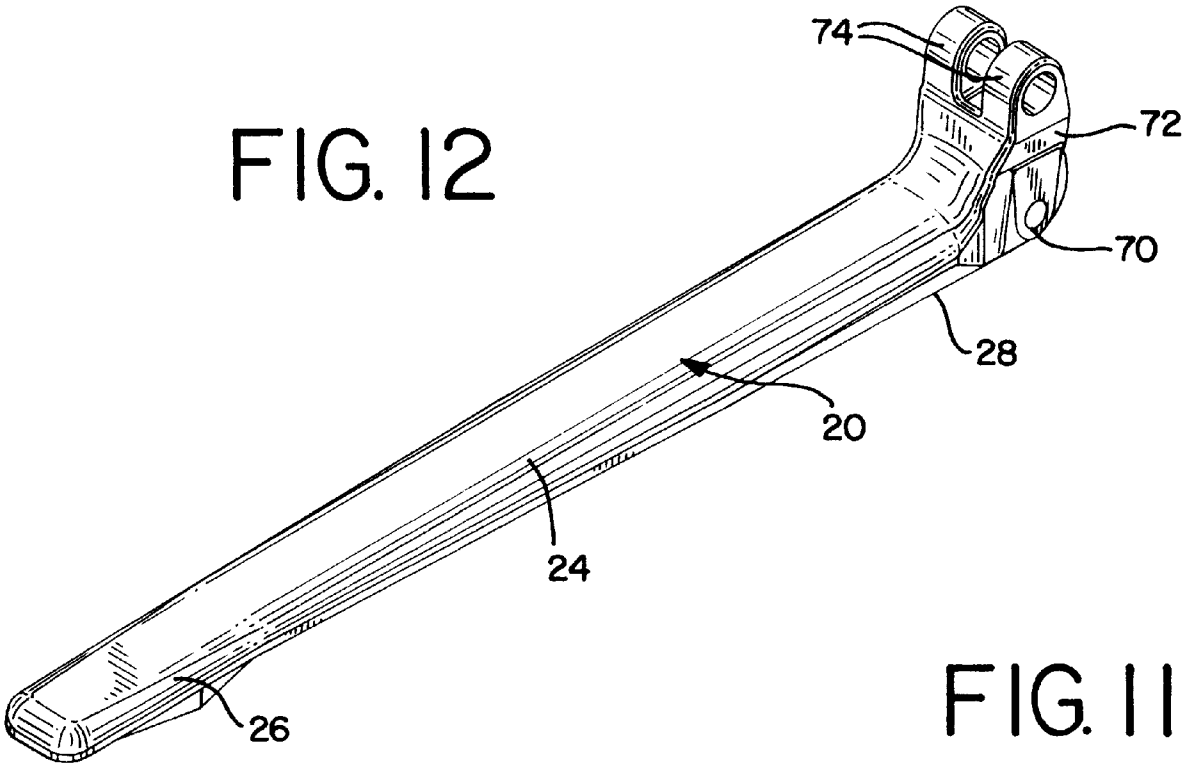
FIG. 12 is a top perspective view of a support foot.
Figure 11:
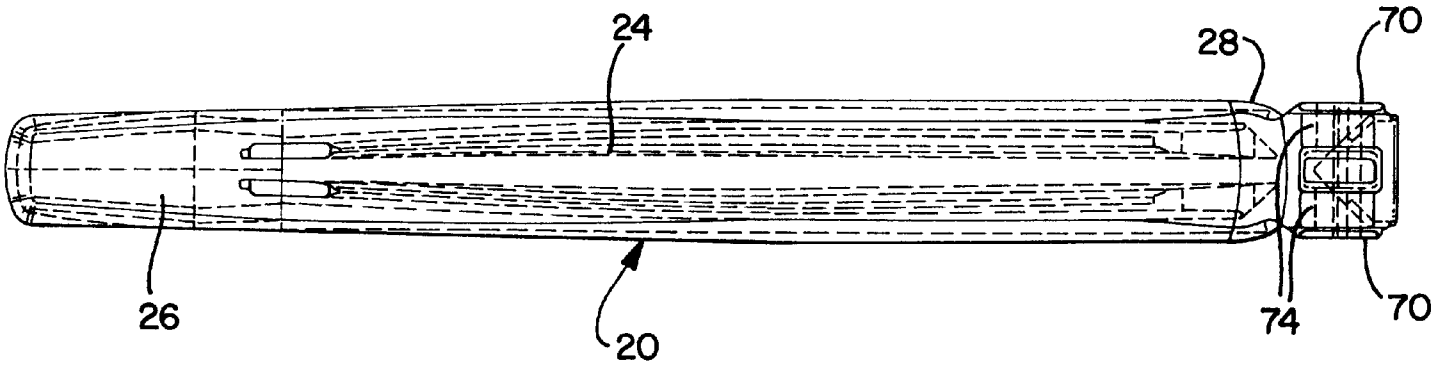
FIG. 11 is a top plan view of a support foot.

Alternatively, as illustrated in FIG. 10, the cap member 230 is received within the top of the lower leg member 34, which is preferably configured as a generally open steel tube as described above. The cap member 230 is attached to the lower leg member 34 with a plurality of fasteners (not shown). The cap member 230 has a socket 232 shaped to receive a multi-faceted post member 222 extending downwardly from a support bracket 227. In this embodiment, the socket 232 has an octagonal cross-section with eight side walls 234.

In the embodiment shown in FIG. 9, the opening in the upper end of the first tube 200 forms a socket 212. As with socket 232, socket 212 is shaped to receive the post member 222 extending downwardly from the support bracket 220. In this embodiment, one half of the socket 212 has a rectangular cross-section, with three sides 213, 214, and 215 formed at 90 degrees to each other. The other half of the socket 212 has an octagonal cross-section, with five sides 213, 215, 216, 217, and 218 formed at 45 degrees to each other. It should be understood that the socket could also be made symmetrical so that it has a complete octagonal cross-section similar to the socket 232 shown in FIG. 10.

As shown in FIGS. 9, 10, and 14–16, the support bracket 227 also includes a base section 225 and two support arms 226 extending outwardly from the base section 225 at an angle of about 90 degrees relative to each other. The post member 222 extends downwardly from the base section 225. Preferably, the multi-faceted post member 222 has eight planar side surfaces 224 forming an octagonal cross-section. Preferably, the support bracket 227 is an aluminum casting, although it should be understood that other materials, such as steel, would work equally well.

Figures 14, 15, 16:
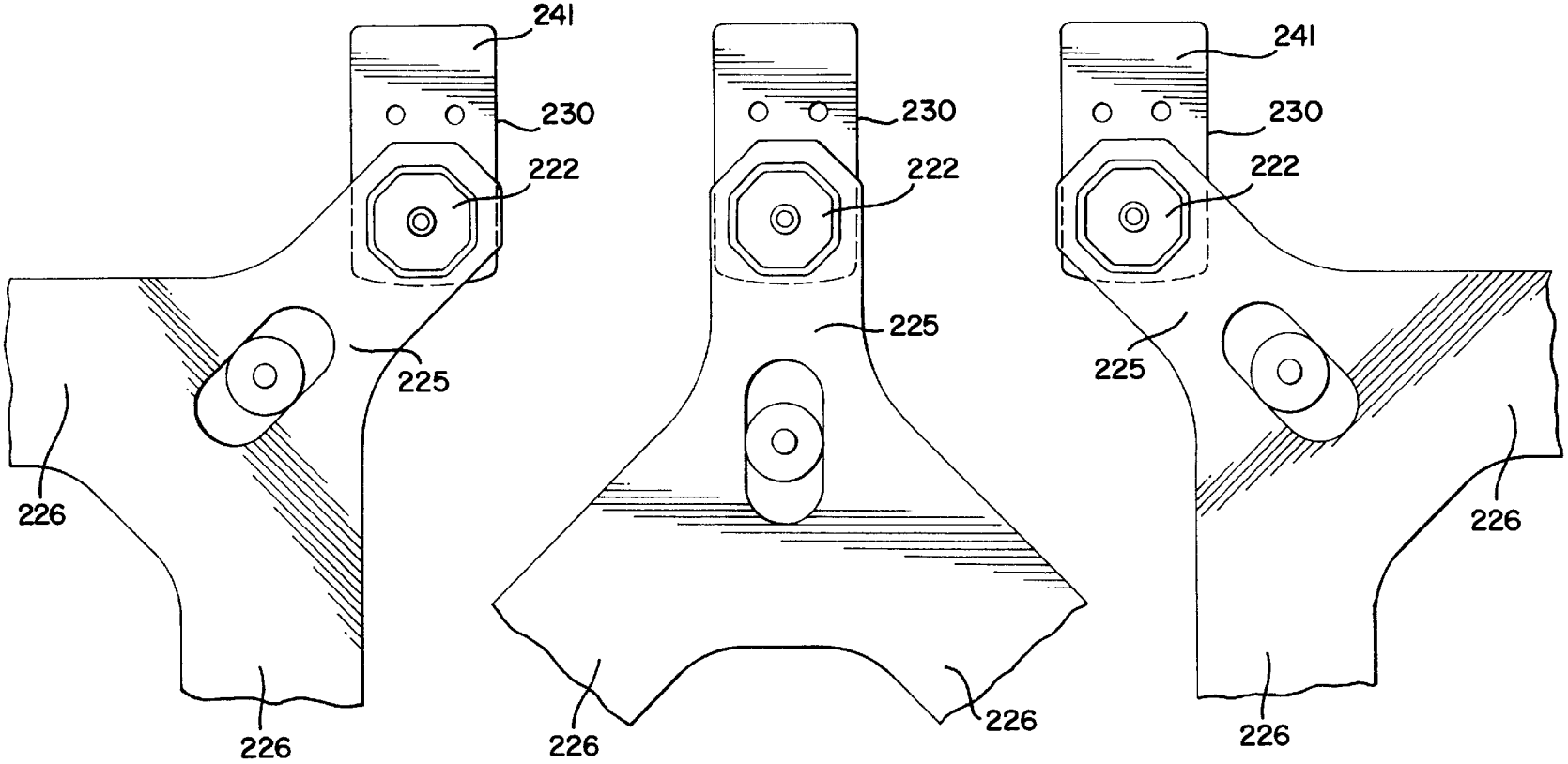
FIG. 14 is a partial top view of a support bracket mounted on a support leg in an intermediate position.
FIG. 15 is a partial top view of a support bracket mounted on a support leg in a right-side position.
FIG. 16 is a partial top view of a support bracket mounted on a support leg in a left-side position.

The shape of the post member 222 and sockets 212, 232 are such that the support bracket 227 can be releasably mounted to the leg member 30 in a plurality of positions by inserting the post member 225 into the socket 212, 232. A bottom surface 240 of the base section 225 engages the top of the upper leg member 35 or the top surface 241 of the cap member 232. Preferably, the support bracket 220 can be rotated between at least three positions relative to the leg member, as shown in FIGS. 14–16: a first position wherein the support bracket 227 is positioned along one side of the worksurface member with one of the support arms 226 lying approximately parallel to the deployed foot member 20 and the other support arm 226 facing inwardly beneath the work surface member, a second intermediate position wherein the support bracket 220 is rotated 45 degrees relative to the first position along the longitudinal vertical axis of the leg member such that each of the support arms 226 lies at approximately 45 degrees to the deployed foot member 20, and a third position wherein the support bracket 227 is rotated 45 degrees relative to the second position (90 degrees relative to the first position) along the longitudinal axis of the leg member such that one of the support arms 226 is aligned approximately parallel with the deployed foot member and the other support arm faces inwardly beneath the work surface. In this way, the support assembly is modular, and can be used interchangeably at any position beneath the worksurface member without having to maintain extra parts (right, left or intermediate support brackets or leg members) in inventory.

It should be understood by one of skill in the art that the multi-faceted post member and socket can also be configured to have a plurality of side surfaces, or faces, greater than eight so as to allow the support bracket and leg member to be positioned in at least the three aforementioned positions, but also in other positions of varying angular orientation.

Alternatively, the post member can be configured to have a plurality of ridges or teeth which are received in a socket shaped to receive the post member.

It should also be understood by one of skill in the art that the post member could extend upwardly from the leg member and be received within a socket formed in the support bracket.

Figure 8:
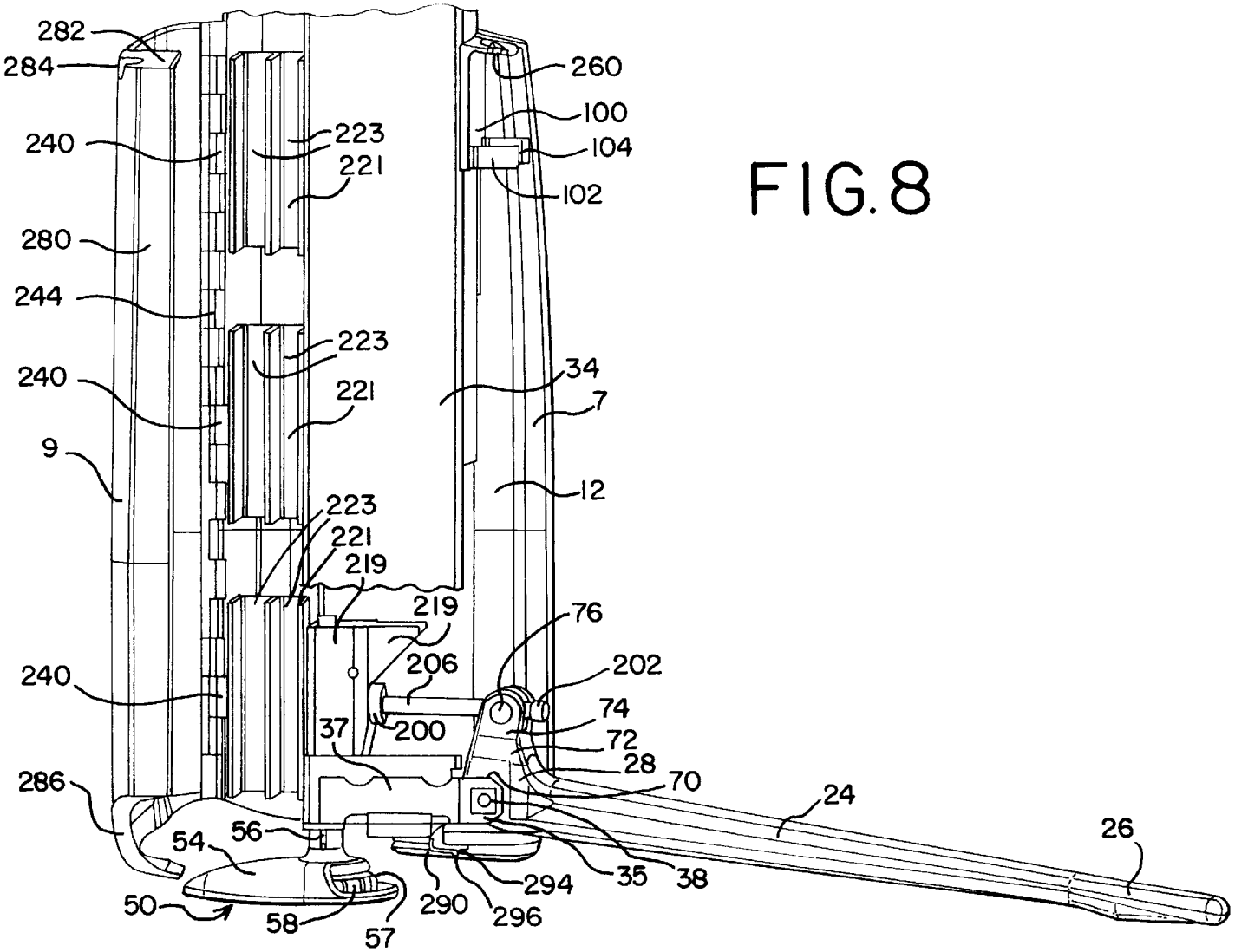
FIG. 8 is a side perspective view of a support assembly with one of the covers swung open on a hinge and with a portion of the leg member cut away.

As shown in FIGS. 1, 8–10, and 21 the leg member 30 includes a cover 8 disposed on the lower leg member 34. The cover 8, which is comprised of a first and second member 7, 9, extends forwardly from the lower leg member 34 to form a cavity 12 between the cover member 7, 9 as shown in FIGS. 1 and 8. Preferably, the cover members 7, 9, are made of high impact plastic. It should be understood that the cover could also be formed as a single piece which wraps around the leg member. As illustrated in FIGS. 8–10 and 21 the cover members 7, 9 can be hinged along a rear portion of the cover members 7, 9 so as to allow one or both of the cover members to be swung open and thereby provide access to the inner structure of the leg member 30, and to cables and the like running vertically along a rear of the leg member. For example, the hinged cover 8 can be opened so that the user can pivot the foot member 2 into the upright position and so as to also enable a user to access a lock member, described below, and a glide device, which facilitates the raising and lowering of the foot member. After the foot member 20 is raised into the upright storable position, the cover members 7, 9 are closed so as to completely conceal the foot member 20 as shown in FIG. 1.

Figure 21:
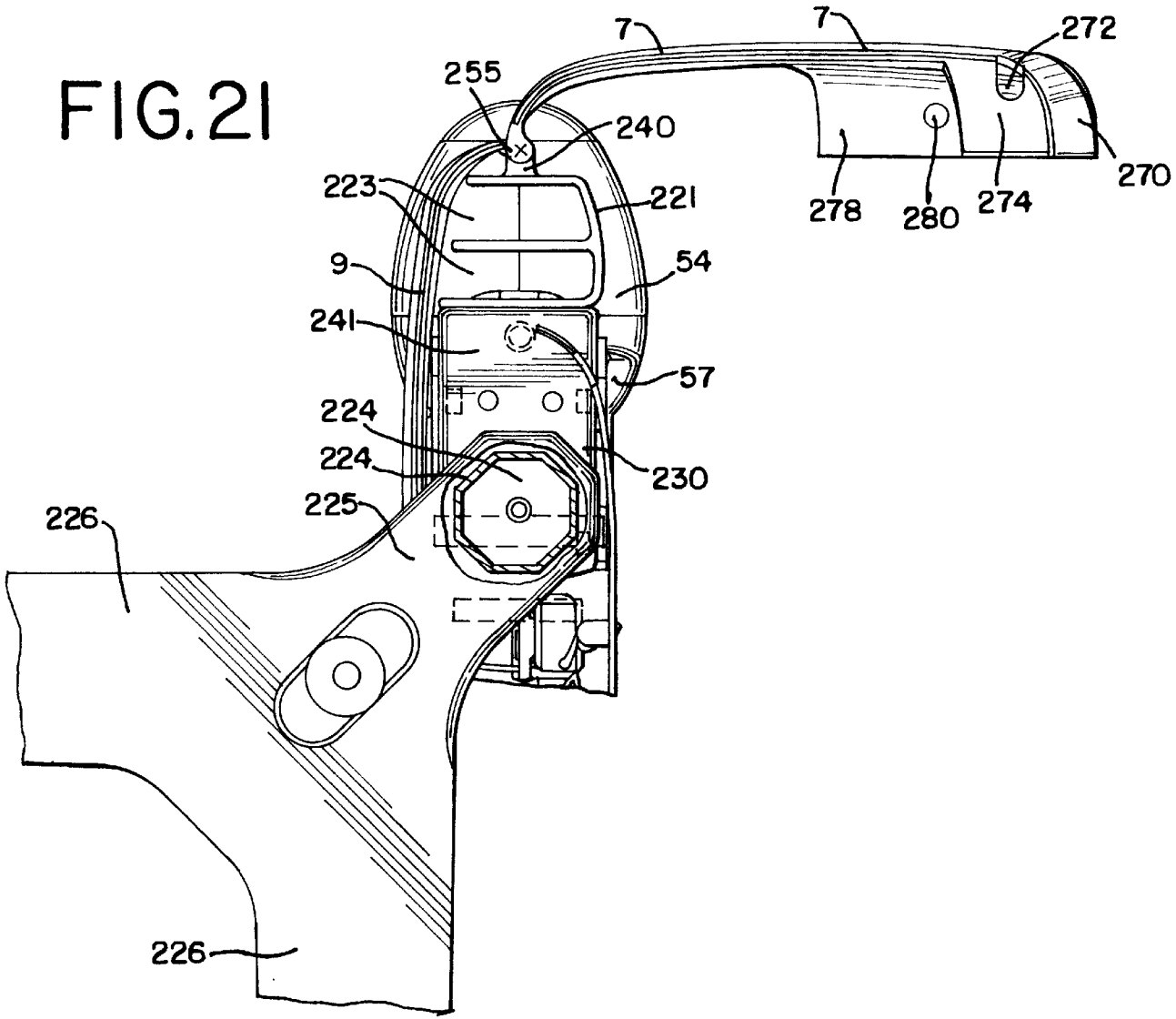
FIG. 21 is a partial top view of the support assembly with one of the cover members swung open on a hinge.
Figure 28:
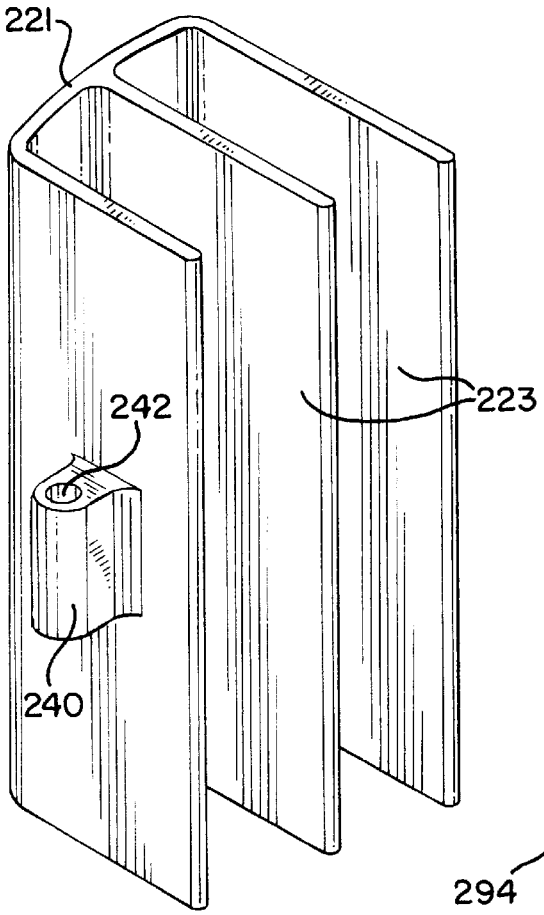
FIG. 28 is a perspective view of a wire management bracket.

As shown in FIGS. 8–9, wire management brackets 221, each comprised of a plurality of channels 223, are disposed between the cover members 7, 9 and attached to a rear surface of the lower leg member with adhesive or fasteners. In this way, wires, cables (not shown) and the like can be concealed and managed as they are routed between the work surface and the floor. Each wire management bracket 221, shown in FIG. 28, includes a rearwardly extending lug 240 having an opening 242 with an axis running parallel to the longitudinal axis of the support leg. A hinge pin 244 is disposed in the openings 242 to secure the cover members 7, 9 to the lower leg member 34 as shown in FIGS. 8, 9 and 21.

As shown in FIGS. 22–27, each of the cover members 7, 9 include a plurality of lug members extending outwardly from the cover member along a rear edge. The plurality of lug members includes a plurality of guide lug members 250 and a plurality of locking lug members 252 having axes generally aligned along the rear edge of the cover members 7, 9 and which are generally parallel to the longitudinal axis of the leg member 30. The guide lug members 250 are each configured as a generally open and resilient hook member having a semi-cylindrical concave inner surface 254. The axis 255 of the circle defined by the guide lug member 250 lies generally parallel to the rear edge of each cover member 7, 9. The hook member is generally open so that the guide lug member is not releasably secured to the hinge pin 244, but simply slidably engages the hinge pin 244 as the cover members 7, 9 pivot about the axis of the hinge pin 244.

The locking lug members 252 are comprised of a resilient C-shaped member having a generally cylindrical inner surface 256 with a slotted opening. The axis 255 of the circle defined by the locking lug member 252 lies generally parallel to the rear edge of the cover members 7, 9. The slot 253, which is formed between the ends of the C-shaped member, generally has a width less than the diameter of the hinge pin 244 such that the locking lug member 15 is releasably secured to the hinge pin 244 when disposed thereon. The hinge pin 244 is installed by biasing the C-shaped members outwardly until the hinge pin 244 is disposed in the locking lug member 252. In this way, the cover members 7, 9 are releasably secured to the hinge pin 244, but pivot about its axis 255.

When in an upright position, the foot member 20 is disposed in the cavity 12 formed between portions of the cover members 7, 9 which extend forwardly from the leg member 30, so that the foot member 20 is concealed from the user's view. In one embodiment, a wire loop 14 is pivotally attached to a top portion 35 of the lower leg member 34 as shown in FIGS. 2–5. The loop 14 is placed over a first end 26 of the foot member 20 when in the upright storage position to prevent it from pivoting downwardly into the lateral support position and interfering with the user's feet and chair.

Figure 29:
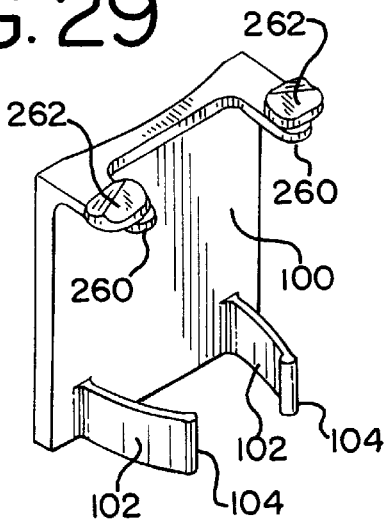
FIG. 29 is a perspective view of a top clip.

Alternatively, a top clip 100 is attached to the front of the support leg as shown in FIG. 8. As illustrated in FIG. 29, the top clip 100 includes a first and second pair of forwardly extending resilient catch members 102, 260. The end of each catch member 102 of the first pair includes a lip portion 104. When in the upright storage position, the first end 26 of the foot member 20 is disposed between the catch members 102 and is retained by the lip portions 104.

Each of the second pair of forwardly extending resilient catch members 260 includes a catch 262 which is adapted to be received within an aperture 272 formed in a top portion of each cover member 7, 9.

Figure 22:
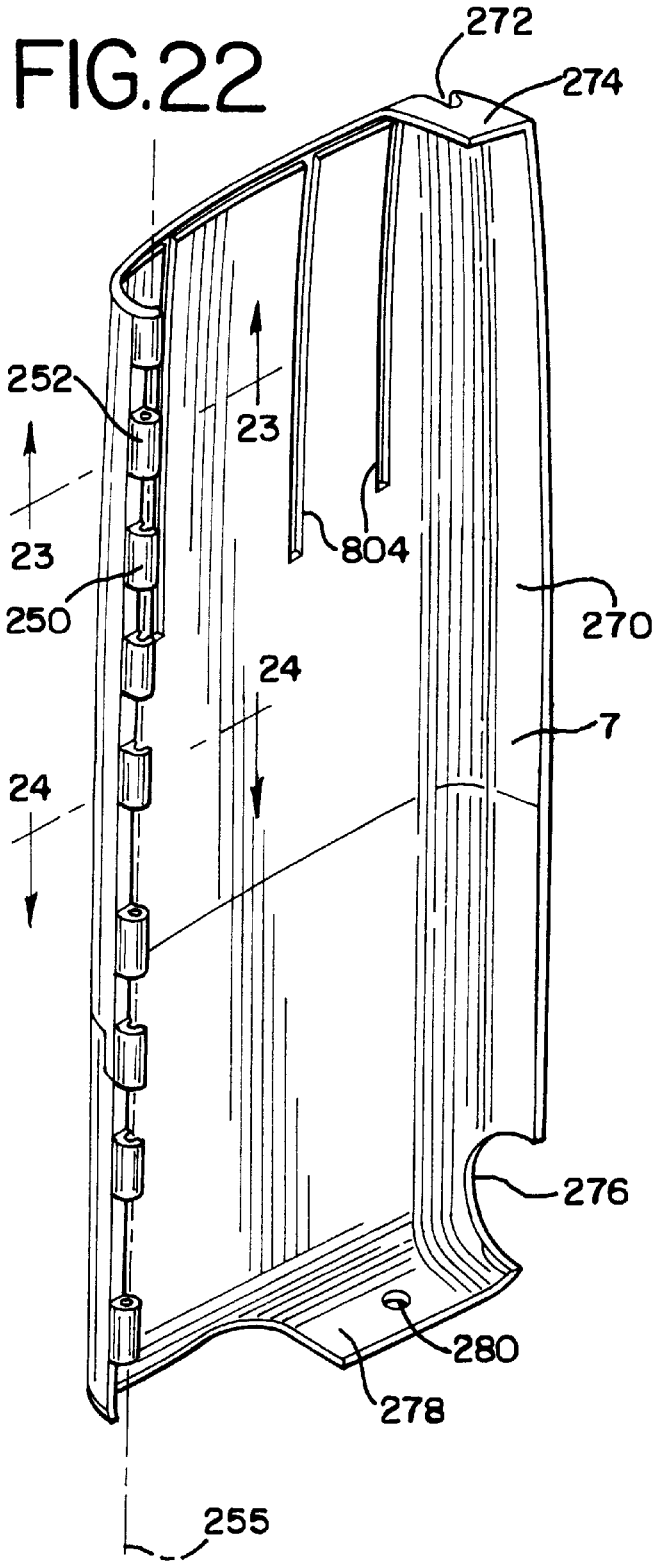
FIG. 22 is a perspective view of a first cover member.
Figure 23:
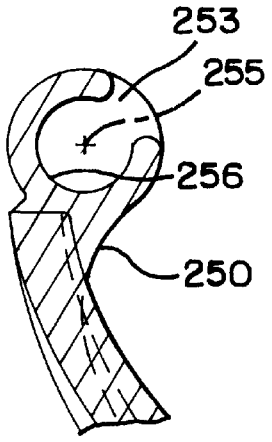
FIG. 23 is a partial cross-sectional view of the first cover member taken along line 23—23 of FIG. 22.
Figure 24:
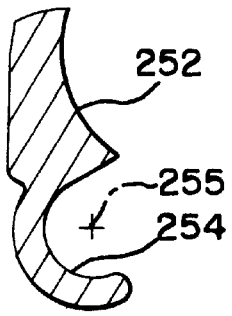
FIG. 24 is a partial cross-sectional view of the first cover member taken along line 24—24 of FIG. 22.
Figure 25:
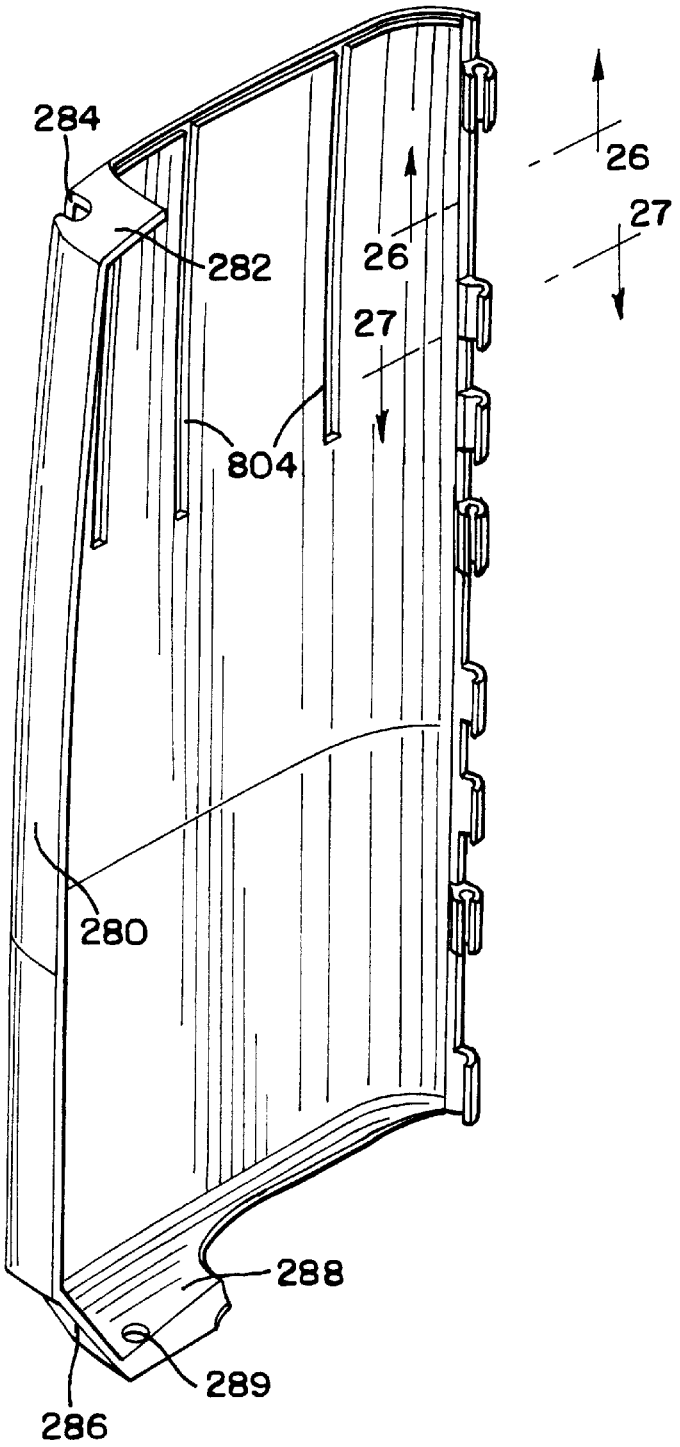
FIG. 25 is a perspective view of a second cover member.
Figure 26:
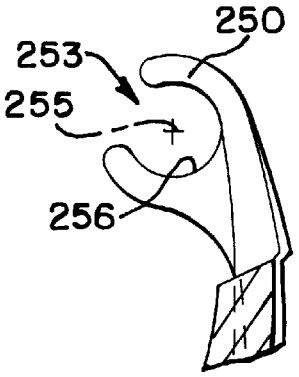
FIG. 26 is a partial cross-sectional view of the second cover member taken along line 26—26 of FIG. 25.
Figure 27:
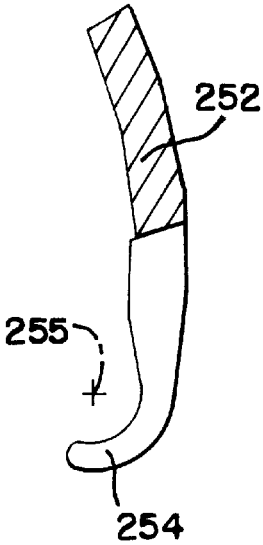
FIG. 27 is a partial cross-sectional view of the second cover member taken along line 27—27 of FIG. 25.

As shown in FIGS. 22 and 25, a forward portion 270, 280 of each cover member 7, 9 curves inwardly so that when the cover members 7, 9 are closed they form a completely enclosed cavity 12 between them. Alternatively, as shown in FIG. 10, the forward portions are spaced apart when the cover members are closed about the leg member, so that the foot member can be rotated into the cavity without having to pivot the cover members outwardly from the leg member. In the preferred embodiment, a top flange 274, 282 is provided at the top of each cover member 7, 9 so as to stabilize the curved forward portion 270, 280. The aperture 272, 284 is formed in the top flange 274, 282. A cut out 276, 286 is provided at the bottom of the forward portion 270, 280 so that the foot member 20 can extend outwardly from the leg member 30 through the opening formed by the cut outs when the cover members 7, 9 are closed. Each cover member 7, 9 also includes a bottom flange 278, 288 having an aperture 280, 289 positioned in it.

Figure 30:
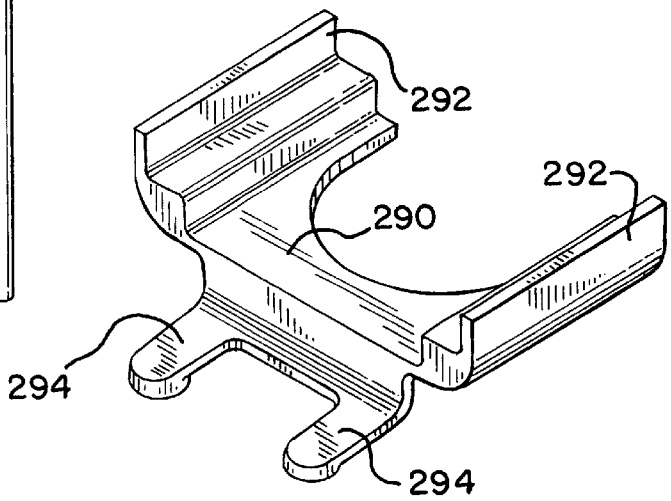
FIG. 30 is a perspective view of a bottom clip.
Figure 31:
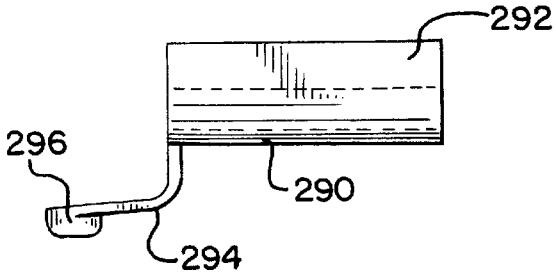
FIG. 31 is a side view of the bottom clip.

As shown in FIGS. 30–31, a bottom clip 290 includes a pair of upwardly extending resilient side walls 292. The bottom clip 290 is disposed on the bottom of the lower leg member 34 as shown in FIG. 8. The bottom clip 290 includes a pair of catch members 294 that extend downwardly and forwardly from the side walls 292. Each catch member 294 includes a catch 296 that is adapted to releasably engage the aperture 280, 289 in the bottom flange 278, 288 of the cover member 7, 9. In operation, the catches 262, 296 engage the openings 272, 280, 282, 289 so as to releasably secure the cover members 7, 9 to the leg member 30.

As shown in FIG. 9, a pair of upper cover members 800, 802 are attached to the cover members 9 and 7 respectively. Preferably, the upper cover members are attached by an interfitting tongue and groove 804 attachment, which allows the position of the upper members to be adjusted as the height of the support legs, and attached work surface member, is adjusted. Alternatively, the upper cover members can be adhesively attached to the cover members or support legs, or can be attached with fasteners.

The foot member 20 includes a support arm 24 having a first 26 and second end 28, as shown in FIGS. 2–3, 11–12. The first end 26 is adapted to engage the floor 40 and the second end 28 is pivotally mounted on the support pin 38 extending between the support plates 36, 37 mounted on the bottom portion of the lower leg member 34. The first end 26 of the support arm 24 engages the floor 40 at a point spaced apart from the point where the heel member 50 engages the floor 40. In this way, the weight of the desk 2 is transferred to the floor 40 through the heel member 50 and the first end 26 of the support arm, with the support arm 24 carrying the bending moment introduced by the cantilevered configuration of the work surface 4. Preferably, the foot member is made from forged aluminum or a ductile iron casting, although it should be understood that other materials would work equally well.

Referring to FIGS. 9–12, a boss 70 extends outwardly from each side of the second end 28 of the support arm 24. When the foot member 20 is pivotally attached to the leg member 30, the bosses 70 contact and engage the lugs 35, 39 on the support plates 37, 36 to provide a friction force between the foot member 20 and leg member 30. The friction force maintains the position of the foot member relative to the leg member when not acted upon by a user or installer.

The foot member 30 also includes a lock arm 72 extending laterally from the second end 28 of the support arm 24. The lock arm 72 includes a pair of lugs 74. A steel pivot shaft 76 is rotatably mounted to and extends between the lugs 74. The pivot shaft 76 has a threaded opening 78 passing through it. The axis of the opening 78 is generally perpendicular to the axis of the shaft 76. The opening 78 is located in the shaft at the approximate midpoint between the lugs 74 and is exposed in the space formed between the lugs 74.

Figure 5:
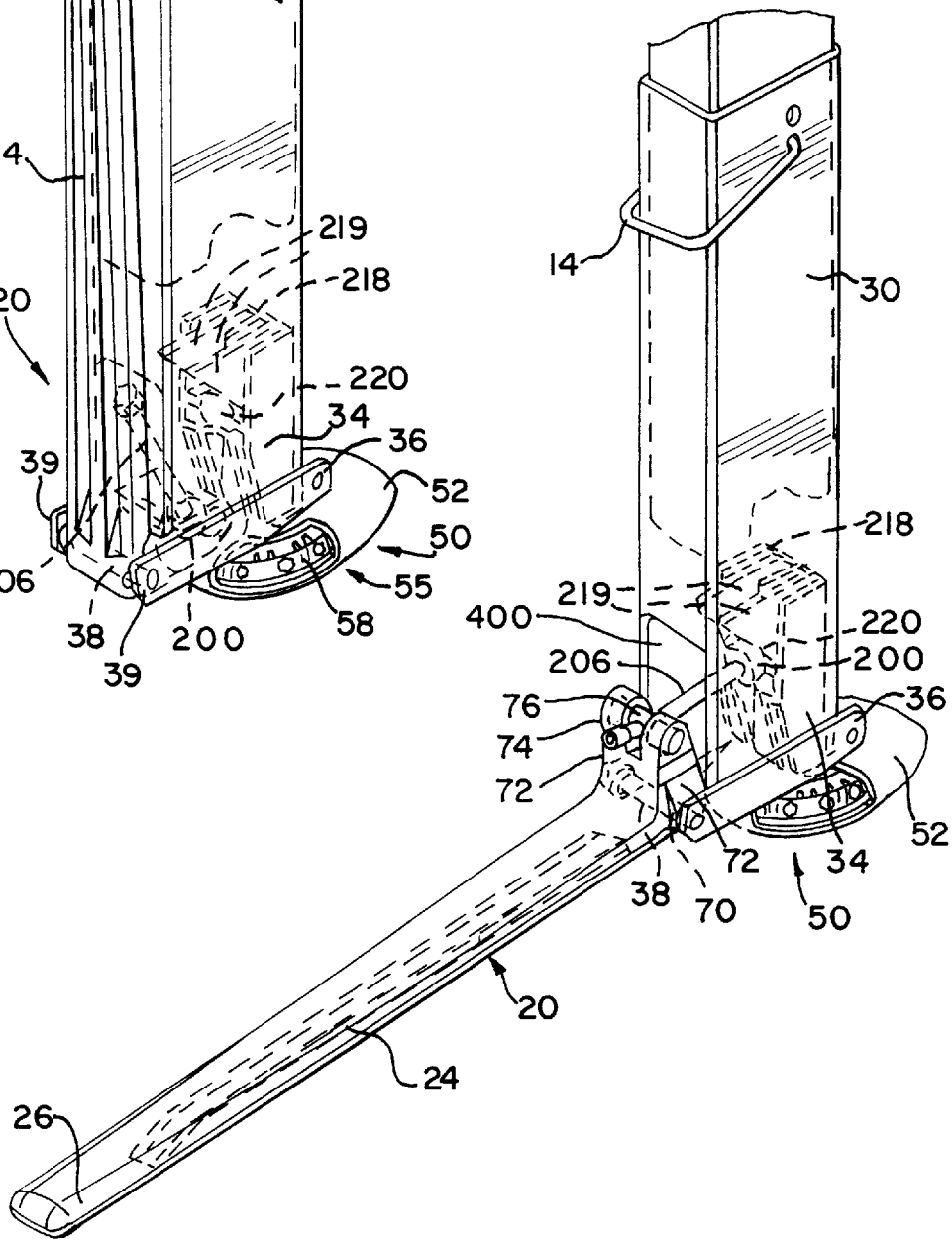
FIG. 5 is a perspective view of a support assembly, with the cover omitted, having a storable foot support in a lateral support position.
Figure 17:
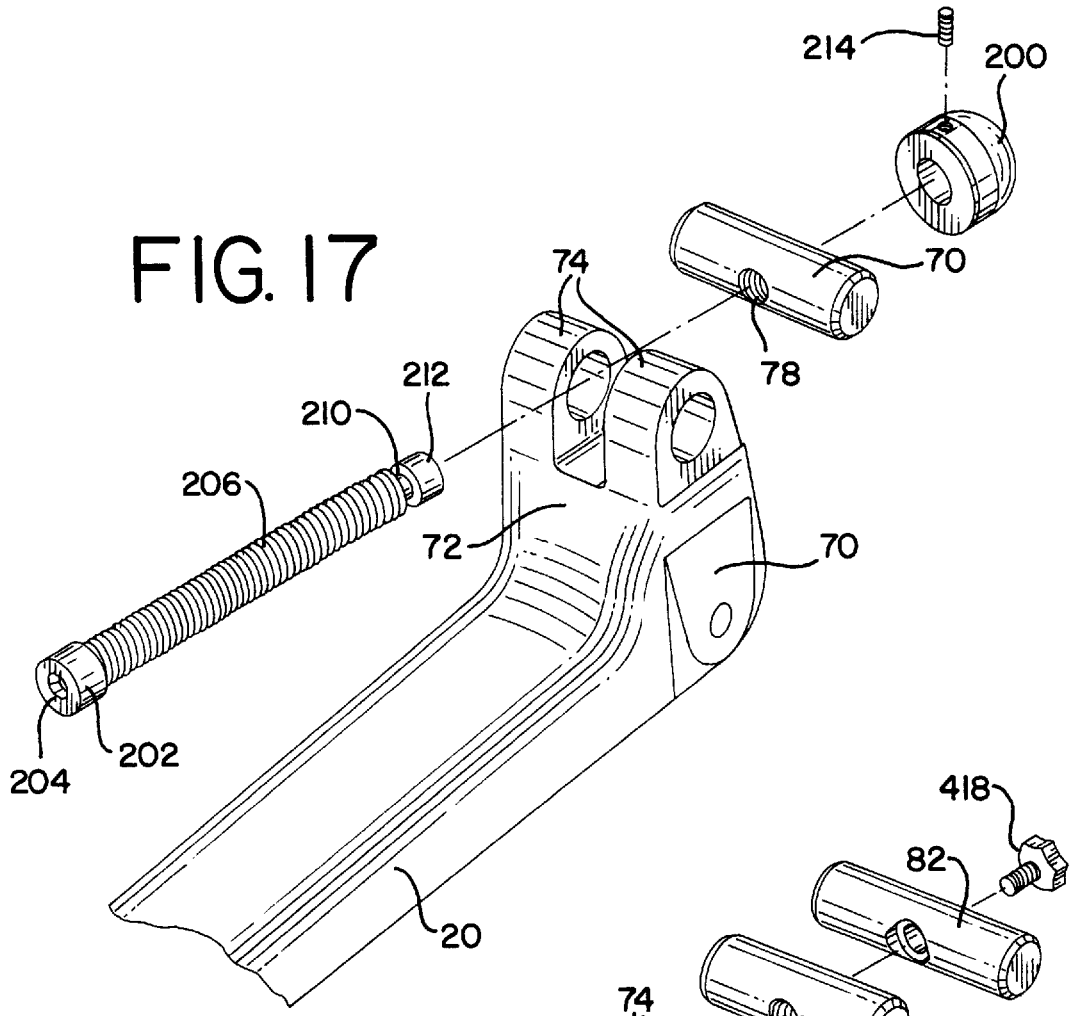
FIG. 17 is an exploded view of an embodiment of the lock member.

Referring to FIGS. 3, 5, 7 and 8 the foot member 20 is shown in the lateral support position. To maintain the position of the foot member 20 when engaging the floor 40, and to stabilize the leg member 30, a lock member is provided to releasably engage the leg member 30. As shown in FIGS. 3–5, the lock member is configured as an adjustable brace member 80, 206, that releasably connects the lock arm 72 and the leg member 30. The brace member 80, 206, preferably a steel bolt or shaft, threadably engages the opening 78 in the pivot shaft 76. Referring to FIGS. 9 and 17, one embodiment of the brace member 206 includes a threaded shaft, a first end with a head 202 having a hex-shaped aperture 204 adapted to receive an allen wrench or similar tool, and a second end having a circumferential groove 210 separating the shaft 206 from an end portion 212. The threaded shaft threadably engages opening 78 in pivot shaft 70.

A swivel member 200 is disposed on the end portion 212 and is rotatably connected to the second end of the brace member by extending a lock member 214 from the swivel member into the circumferential groove 210. The swivel member 200 has a semispherical shaped end portion and is preferably made of steel.

Figure 18:
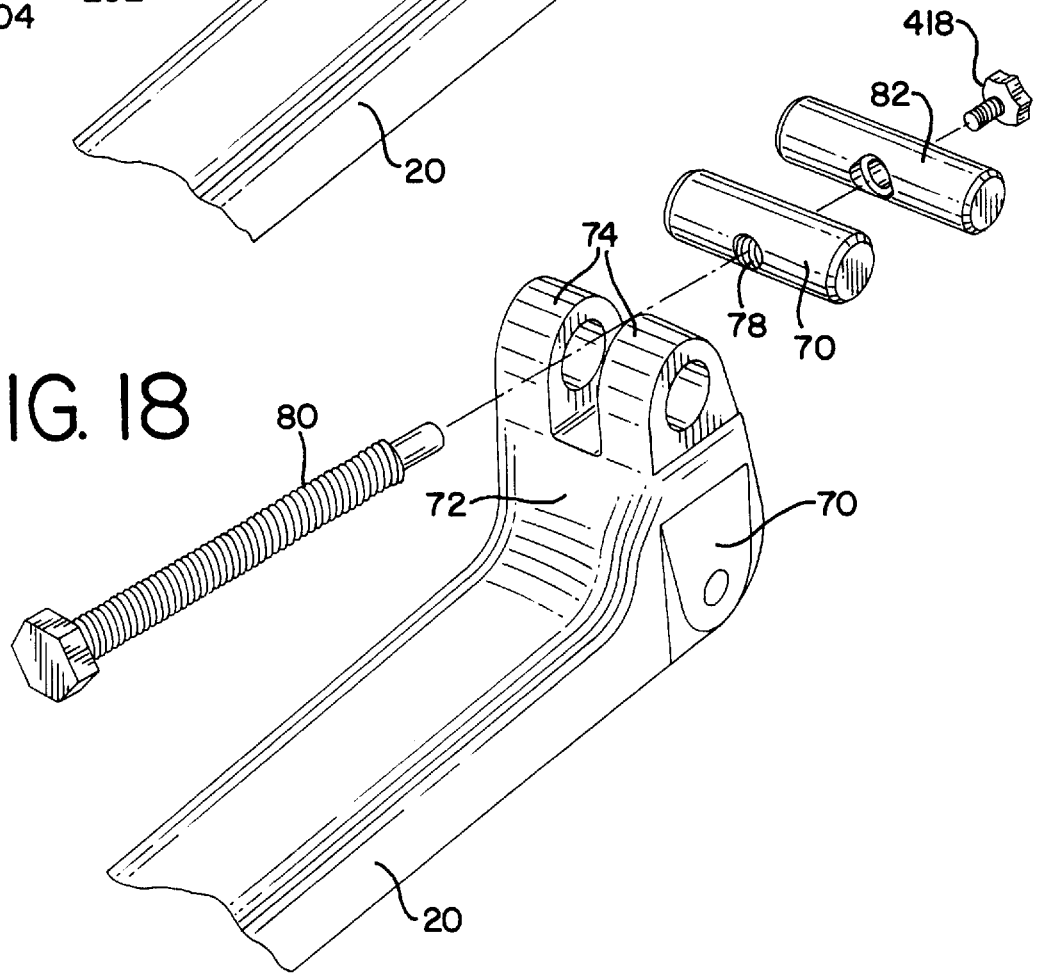
FIG. 18 is an exploded view of an alternative embodiment of the lock member.

In an alternative embodiment, shown in FIGS. 6, 7, 10 and 18, a steel bar member 82 is rotatably attached to the end of a brace member 80 opposite the end pivotally attached to the lock arm 72. A set screw 418 secures the bar member 82 to the brace member 80. The brace member 80 includes a hex head which can be rotated with a wrench, or the like. The brace member 80 is threaded so that it can threadably engage opening 78 in pivot shaft 70. As shown in FIG. 18, the bar member 82 is cylindrical, although it should be understood that other shapes are acceptable.

Figure 6:
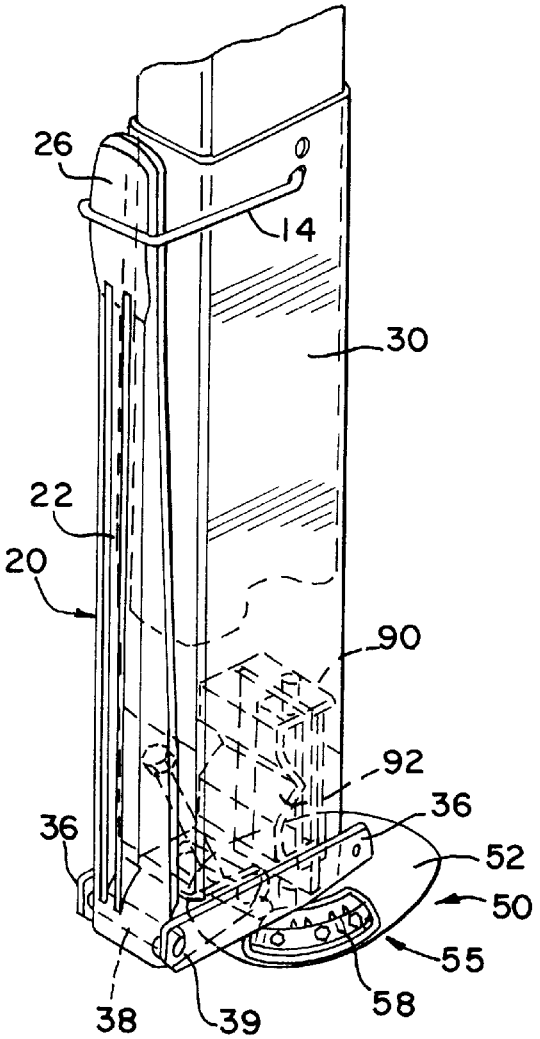
FIG. 6 is a perspective view of an alternative embodiment of the support assembly, with the cover omitted, having a storable foot support in an upright storage position.
Figure 7:
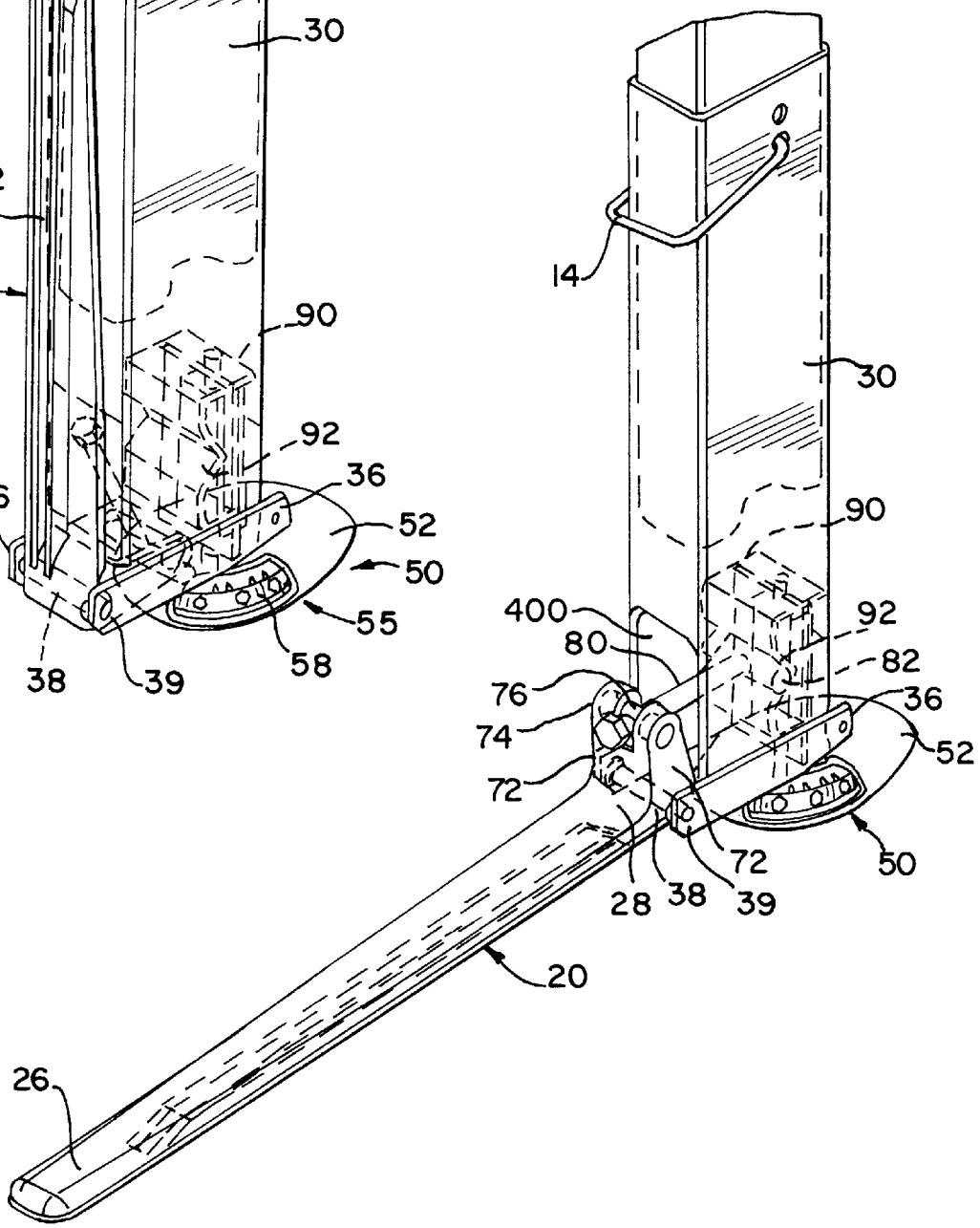
FIG. 7 is a perspective view of an alternative embodiment of the support assembly, with the cover omitted, having a storable foot support in a lateral support position.

Referring to FIGS. 2–5, 8–9 and 13, a bracket 218 is mounted to the rear part of the bottom portion 34 of the leg member 30. In one embodiment, the bracket 218 includes a socket 220 shaped to receive the swivel member 200. The bracket 218 also includes a pair of flanges 219 which prevent the swivel member 200 from moving upward and also help guide it into the socket 220. Alternatively, as shown in FIGS. 6, 7 and 10, a bracket 90 is provided which includes a forwardly facing horizontal V-shaped groove 92, which functions as a contact surface and is shaped to receive the bar member 82. The bracket can be manufactured as a formed steel weldment, or as an aluminum casting.

To deploy the storable foot support, the user removes the wire loop 14 from the foot member 20, or disengages the catch members 102, and pivots the foot member 20 about a horizontal axis of rotation out of the cavity 12 and into the lateral support position. A bottom forward portion of the leg member is cut away to form opening 400 as shown in FIGS. 2–5, 9 and 10 so as to allow the lock arm 72 to pivot from a position within the leg member 30 to one outside the leg member 30.

As described above, the cover members 7, 9 are pivoted about the hinge pin 244 to expose and provide access to the stored foot member 20. Alternatively, as described above, forward portions of the cover members are spaced apart to form an opening through which the foot member can pass as it is pivoted to the lateral support position. The brace member 80, 206 then is rotated about the pivot shaft 76 until the swivel member 200 is aligned with the socket 220 in the bracket 218, or until the bar member 82 is aligned with the V-shaped notch 92 in the bracket 90. The user then rotates the brace member 80, 206 in the threaded opening 78 of the pivot shaft 76 so that the swivel member 200 operably engages the socket 220, or so that the bar member 82 operably engages the groove 92, through a contact interface, thereby bracing the foot member 20 against the leg member 30. The moment from the cantilevered work surface is transferred to the foot support through a coupled force reacted through the brace member 80, 206 and the support pin 38. In such a configuration, the brace member 80, 206 is in compression, while the support plates 36, 37 are in tension.

Because the bar member 82 is rotatably mounted to the brace member 80, bar member 82 remains engaged with the notch 92 as the brace member 80 is rotated. Similarly, the swivel member 200 rotatably engages the socket 220. Once the brace member 80, 206 engages the bracket 90, 218, the distance between the lock arm 72 and leg member 30 can be increased or decreased by rotating the brace member 80, 206. In this way, the angular orientation of the leg member 30 is controlled by the relative distance between the lock arm 72 and the leg member 30. As such, the brace member 80, 206 can be used to level the support assembly and desk.

To disengage the foot member 20, the reverse procedure is followed; the brace member 80, 206 is loosened so that either the swivel member 200 or the bar member 82 become disengaged from either the socket 220 or the groove 92, respectively. In one aspect, the brace member can be allowed to rotate about the pivot shaft by the force of gravity and hang down or rest on the floor. Alternatively, the brace member 80, 206 can be completely unscrewed so that the bar member 82 or swivel member 200 is not exposed below the support leg, as shown in FIGS. 2, 4 and 6.

The cover members 7, 9 are opened and the foot member 20 is rotated about the horizontal axis of rotation into the upright storage position where the cover members are closed so that the foot member 20 is disposed in the cavity 12. Alternatively, the foot member is passed through the opening formed between the forward portions of the cover members. The wire loop 14 is deployed to releasable engage the foot member 20 and prevent it from inadvertently falling. Alternatively, the foot member biases the catch 102 members outwardly until it is received between them, whereby the lip portion 104 retains the foot member 20 in the stored position.

The adjustable brace member 80, 206 provides a simple and easy way both to deploy and to disengage the foot member 20. Indeed, it should be understood that the brace member 80, 206 need only be unscrewed a small amount to disengage the swivel member 200 from the socket 220 or to disengage the bar member 82 from the groove 92 formed in the bracket. Once the swivel member 200 or bar member 82 is clear of the bracket, the foot member 20 can be pivoted into the upright storage position.

Alternatively, the brace member 80, 206 can be disengaged from the bracket 90, 218 without rotating the brace member 80, 206. Rather, the user simply lifts the front of the work surface member while keeping the foot member 20 on the floor, so as to increase the angle between the foot member 20 and the leg member 30 as the foot member pivots downwardly with respect to the leg member. As the foot member 20 pivots, the lock arm 72 rotates away from the leg member 30 so that the brace member 80, 206 disengages from the bracket 90, 218 and falls down due to the force of gravity. The work surface can then be lowered and the foot member 20 rotated into the upright storage position as described above.

Figure 19:
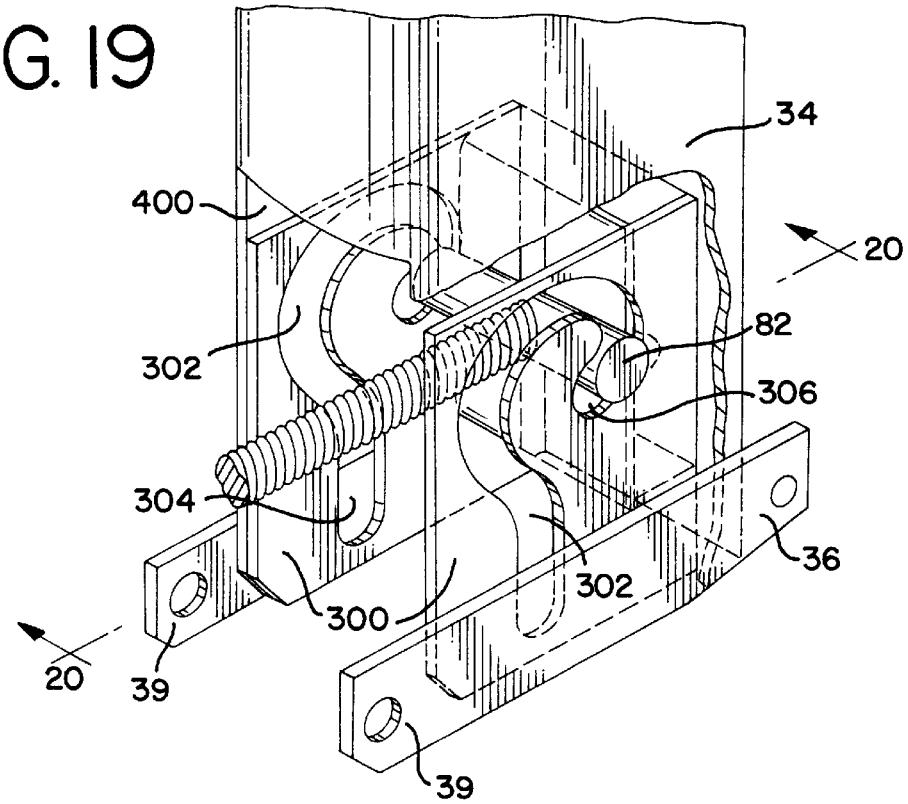
FIG. 19 is a partial perspective view of a bar member and a pair of guide plates mounted inside a leg member, with portions of the leg member cut away.
Figure 20:
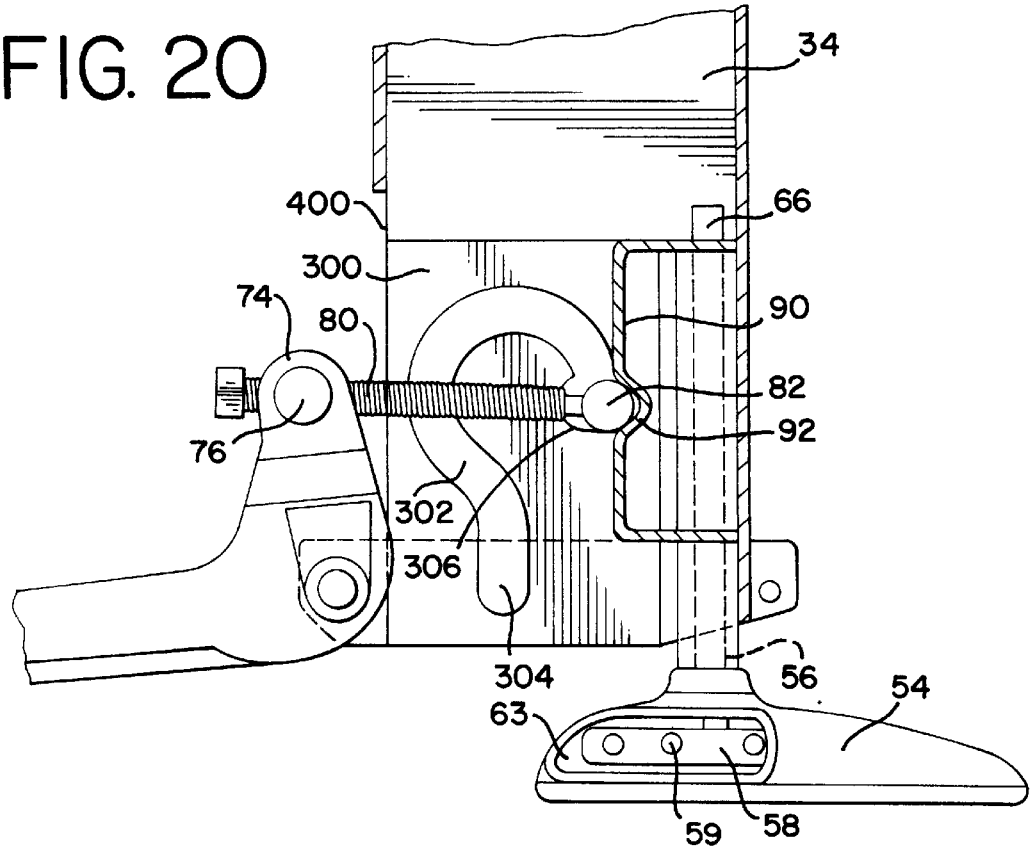
FIG. 20 is a partial cross-sectional view of the support assembly taken along line 20—20 of FIG. 19, but with the support foot and glide device.

Alternatively, if it is desired to prevent disengagement of the brace member 80, 206 when the work surface is lifted in the manner just described, a pair of guide plates 300 can be mounted to opposite inner sides of the lower leg member 34 as shown in FIGS. 19–20. The guide plates 300, in combination with the bracket 90, lock the bar member 82 in place so that the brace member 80 cannot become disengaged from the leg member 30.

Specifically, each guide plate 300 includes a slot 302 generally shaped like a question mark. The slot 302 terminates in an upper end 306 and a lower end 304. Opposite ends of the bar member 82 are disposed in and are guided by slots 302 which are aligned in opposing guide plates as shown in FIG. 19. The upper end 306 of the slot is turned slightly forward so as to provide a locking position as shown in FIG. 20.

In operation, the bar member 82 lies in the lower ends 304 of the slots when the foot member 20 is in the upright storage position. As the installer lowers the foot member 20, the bar member 82 moves upwardly within the slots 300 as the lock arm pivots outwardly from the leg member 30 through opening 400 until the foot member 20 is placed in the lateral support position. The brace member 80 is then rotated so that bar member 82 rides along the slots 302 until it is positioned near the upper ends 306 of the slots and engages the groove 92 in the bracket 90. In that position, the bar member 80 is trapped between the upper ends 306 of the slots, so that even if the work surface is lifted, the bar does not fall down but is pulled into the forwardly turned portion of the slots 306. In this position, the foot member 20 cannot rotate and thereby disengage from the leg member 30.

In addition, the guide plate 300 ensures that bar member 82 and brace member 80 do not hang down below the bottom of the leg member when disengaged, and thereby provide an unsightly appearance to the user. Specifically, the installer is forced to unscrew the brace member 80 a sufficient amount so as to allow the foot member 20 to be rotated into the upright storage position while the bar member 82 travels to the lower end 304 of the slot.

In an alternative embodiment not shown, the brace member threadably engages the bracket and operably engages the lock arm. In this embodiment, the pivot arm has a socket, groove, or similar contact surface, which interfaces with the brace member. The opposite end of the brace member threadably engages the bracket.

Although, as shown in the accompanying figures, the lock arm is disclosed as extending upwardly from the support arm when the foot member is in the lateral support position, it should be understood that the lock arm can also extend downwardly from the support arm. In this embodiment, the brace member is in tension rather than compression. Therefore, the end of the bolt must operably engage the bracket in a different fashion. For example, the bracket can be configured so that the bolt extends through and is rotatably attached to the bracket.

Referring to FIGS. 2–7 and 13, the heel member 50 can be made height adjustable, thereby giving the support assembly further leveling capability. In particular, the heel member 50 is configured as a glide device that has a housing 52, a shaft 60 and an actuator 58. The housing 52 includes a base portion 54 that is adapted to engage the floor, and a stem portion 56 that extends upwardly from the base portion 54. The housing 52 is preferably formed from an aluminum casting. The base portion 54 has a cavity 55 formed therein and an opening 57 defining a mouth of the cavity 55. The base portion 54 can be configured so that the mouth opens in any direction. For example, as shown in FIGS. 8–10 and 13, the mouth 57 opens to the front of the glide device, while in FIGS. 1, 6 and 7, two mouths 63 open, one to each side of the glide device. In this way, the actuator is largely hidden from view while an aesthetically pleasing housing is exposed.

Figure 13:
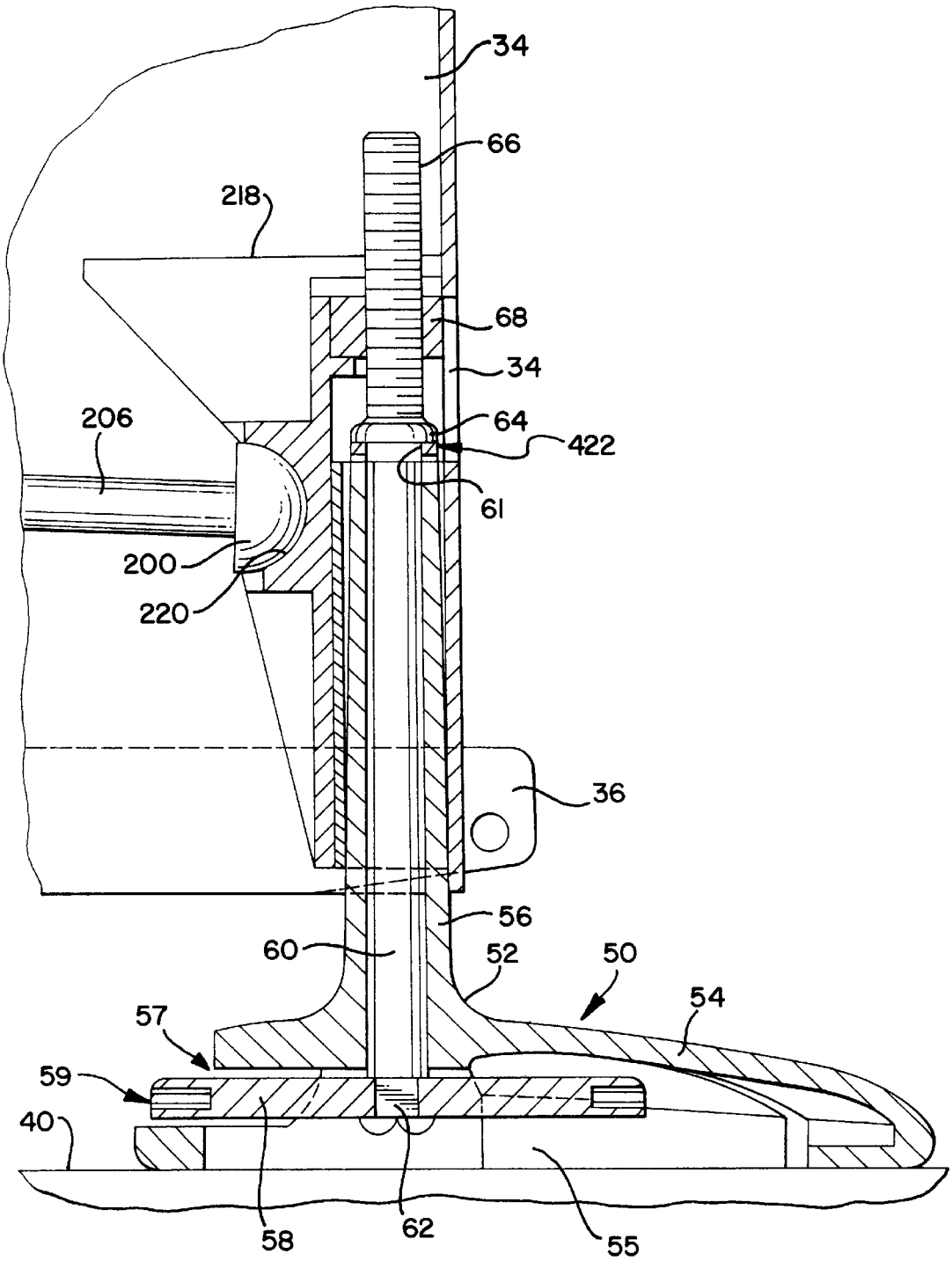
FIG. 13 is a partial cross sectional view of a glide device and leg member.

The actuator 58, preferably configured as a disk member, is disposed in the cavity 55 so that a portion of it protrudes from the mouth 57 of the cavity as shown in FIG. 13. Preferably, a plurality of apertures 59 are positioned about the perimeter of the disk member. The actuator is preferably made from an aluminum casting, although it also can be formed out of plastic, steel or any other suitable material. The apertures 59 are adapted to receive an allen wrench, or similar tool, whereby a user can use the wrench as a lever to rotate the disk member 58 in the housing 52. Alternatively, the peripheral edge of the disk member is provided with a grippable surface, such as a plurality of ridges, so that the user can rotate the disk member with their thumb or similar device.

The shaft 60 is disposed in the stem portion 56. The disk member 58 is mounted on a bottom end 62 of the shaft, so that the disk member 58 is rotatably mounted in the housing 52. Preferably, the bottom end 62 is a square tube and is disposed in a similarly square shaped hole centered in the disk member 58. The bottom end 62 is spin riveted to secure the disk member 58 to the shaft 60.

The disk member 58 and shaft 60 have concentric axes of rotation. The shaft 60 has a shoulder 64 which is adapted to engage a top 61 of the stem as shown in FIG. 13. Alternatively, a washer 422, preferably made of DELRIN, can be disposed between the shoulder and stem to facilitate rotation of the shaft as shown in FIG. 9. An upper portion 66 of the shaft, above the shoulder 64, is threaded. The threaded upper portion 66 engages a nut 68 mounted in the rear portion of the leg member 30, or secured in the bracket member 218, 90.

In operation, the user rotates the actuator 58, or disk member, either by rotating it with their thumb, or by using the wrench as a lever. As the actuator 58 rotates the shaft 60, it engages the nut 68 disposed in the rear portion of the leg member 30 or secured to the bracket member 218, 90, thereby moving it in a generally vertical direction. The weight of the desk is transferred from the leg member 30 through the nut 68 to the shaft 60, which is preferably steel. The shaft 60 then transfers the load from the shoulder 64 to the stem 56, preferably through washer 422, and then to the floor 40 through the base portion 54. As such, the actuator does not carry any load. If the desk is heavily loaded, and the friction force between the shoulder and stem makes rotation of the actuator difficult, the desk can be lifted to relieve the load while the user rotates the actuator. Such an arrangement provides a simple, yet efficient device for supporting and leveling a support assembly.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A support assembly for supporting an object on a floor, said support assembly comprising:

a leg member;

a foot member pivotally attached to said leg member about a horizontal axis of rotation, said foot member pivotable between an upright storage position and a lateral support position; and a brace member connecting said leg member and said foot member when said foot member is in the lateral support position so as to prevent said foot member from pivoting into said upright storage position, said brace member threadably engaging one of said foot member and said leg member and operably engaging the other of said foot member and said leg member, said brace member having a longitudinal extent defining an axis of threadable rotation, said axis of threadable rotation being substantially perpendicular to said horizontal axis of rotation, wherein said brace member is rotatable about said axis of threadable rotation, and wherein said threadable engagement of said brace member with said one of said foot member and said leg member pivots said foot member relative to said leg member about said horizontal axis of rotation.

2. The support assembly of claim 1 wherein said foot member comprises a support arm adapted to engage said floor when in said lateral support position and a lock arm extending laterally from said support arm.

3. The support assembly of claim 2 wherein said brace member threadably engages one of said lock arm and said leg member and operably engages the other of said lock arm and said leg member.

4. The support assembly of claim 3 wherein said brace member threadably engages said lock arm.

5. The support assembly of claim 4 wherein said lock arm comprises a pair of lugs and a shaft rotatably mounted to said lugs, said shaft having a threaded opening positioned between said lugs, wherein said brace member threadably engages said shaft at said threaded opening, and wherein said brace member operably engages said leg member opposite said shaft.

6. The support assembly of claim 5 wherein said leg member further comprises a pair of side walls and a pin mounted between said side walls, wherein said foot member is pivotally mounted on said pin.

7. The support assembly of claim 6 wherein said side walls further comprise a support plate disposed along each side of a bottom portion of said leg member, and wherein said pin is mounted to said support plates.

8. The support assembly of claim 4 further comprising a bracket disposed in said leg member, said bracket having a forwardly facing groove, and a bar member rotatably attached to an end of said brace member, said bar member adapted to operably engage said groove when said foot member is in the support position.

9. The support assembly of claim 8 wherein said bar member is removed from said groove when said foot member is in said upright storage position.

10. The support assembly of claim 8 further comprising a pair of guide members each having a slot, wherein said bar member is slidably disposed in said slots, and wherein said foot member is locked in place when said bar member is trapped between said groove and one end of said slot.

11. The support assembly of claim 1 wherein said leg member further comprises a bracket disposed in said leg member, said bracket having a forwardly facing socket, and said brace member further comprising a swivel member rotatably attached to an end of said brace member, said swivel member slidably received in said socket, wherein said brace member braces said foot member against said leg member when said foot member is in said lateral support position.

12. The support assembly of claim 1 wherein said leg member is adapted to conceal said foot member when placed in said upright position.

13. The support assembly of claim 12 wherein said leg member further comprises an inner structure and a cover disposed on said inner structure, said cover extending forwardly from said inner structure to form a cavity, wherein said foot member is disposed in said cavity when placed in said upright storage position.

14. The support assembly of claim 13 wherein said cover further comprises a first and second member attached to said leg member, said cover members forming a cavity between them.

15. The support assembly of claim 14 wherein said cover members are hingedly attached to said leg member, said cover members forming a cavity between them when placed in a closed position, and wherein said cover members can be pivoted to an open position so as to access the foot member when placed in the upright storage position.

16. A desk supported on a floor, said desk comprising:

a work surface member;

a leg member extending downwardly from a rear portion of said work surface member, wherein said leg member has a recess;

a foot member pivotally attached to a bottom of said leg member, wherein said foot member is pivotable between an upright storage position and a lateral support position, and wherein said foot member braces said leg member when in said support position so that the desk is prevented from tipping over; and a brace member connecting said foot member and said leg member when said foot member is in said support position, said brace member having an end portion configured to be removeably received in said recess, said end portion disposed in said recess and abuttingly engaging said leg member when said foot member is in said support position, and wherein said end portion is removed from said recess when said foot member is in said upright storage position.

17. The desk of claim 16 wherein said foot member comprises a first end adapted to engage said floor and a second end pivotally mounted to said leg member about a horizontal axis of rotation, and wherein said second end is connected to said brace member.

18. The desk of claim 17 wherein said foot member further comprises a lock arm extending from the second end of said foot member, and wherein said brace member extends between said lock arm and said leg member.

19. The desk of claim 18 wherein said brace member is pivotally attached to said lock arm and said leg member and releasably engages said leg member.

20. The desk of claim 19 wherein said leg member comprises a bracket, wherein said recess is formed in said bracket, and wherein said brace member releasably engages said bracket when said foot member is positioned in said support position.

21. The desk of claim 20 wherein said recess is formed as a forwardly facing socket, and wherein said end portion of said brace member comprises a swivel member slidably received in said socket.

22. The desk of claim 20 wherein said recess is formed as a substantially horizontal groove, and wherein said end portion comprises a substantially horizontal bar member, wherein said bar member releasably engages said groove when said foot member is positioned in said support position.

23. A support assembly for supporting an object on a floor, said support assembly comprising:

a leg member;

a foot member pivotally attached to said leg member about a horizontal axis of rotation, said foot member pivotable between an upright storage position and a lateral support position, said foot member having a length; and wherein said leg member comprises opposite sides and a first and second cover member mounted to said opposite sides, said cover members forming a cavity, said foot member disposed in said cavity when in said upright storage position.

24. The support assembly of claim 23 wherein said leg member further comprises an inner structure and a cover disposed on said inner structure, said cover forming the cavity.

25. The support assembly of claim 23 wherein the first and second cover members are hingedly mounted to the leg member along a rear portion of the cover members.

* * * * *